US011745909B2

(12) United States Patent
Gonzalez Olmos

(10) Patent No.: US 11,745,909 B2
(45) Date of Patent: Sep. 5, 2023

(54) REINFORCED POLYGONAL CONTAINER MADE OF GLUED CORRUGATED LAMINAR MATERIAL, PRODUCTION METHOD AND MACHINE FOR FORMING SAME

(71) Applicant: TELESFORO GONZALEZ MAQUINARIA, SLU, Alicante (ES)

(72) Inventor: Telesforo Gonzalez Olmos, Santa Pola (ES)

( * ) Notice: Subject to any disclaimer, the term of this patent is extended or adjusted under 35 U.S.C. 154(b) by 193 days.

(21) Appl. No.: 16/753,041

(22) PCT Filed: Dec. 24, 2018

(86) PCT No.: PCT/ES2018/070832
§ 371 (c)(1),
(2) Date: Apr. 2, 2020

(87) PCT Pub. No.: WO2019/141887
PCT Pub. Date: Jul. 25, 2019

(65) Prior Publication Data

US 2020/0346814 A1 Nov. 5, 2020

(30) Foreign Application Priority Data

Jan. 18, 2018 (ES) ..... ES201830052
May 30, 2018 (ES) ..... ES201830796U
May 30, 2018 (ES) ..... ES201830798U

(51) Int. Cl.
*B65D 3/04* (2006.01)
*B31B 50/28* (2017.01)
(Continued)

(52) U.S. Cl.
CPC ..... *B65D 3/04* (2013.01); *B31B 50/28* (2017.08); *B31C 1/06* (2013.01); *B31C 1/083* (2013.01);
(Continued)

(58) Field of Classification Search
CPC ..... B65D 3/04; B65D 3/22; B65D 5/0227; B65D 5/0281; B65D 5/02; B65D 5/18;
(Continued)

(56) References Cited

U.S. PATENT DOCUMENTS 3,873,017 A * 3/1975 Blatt ..... B65D 5/0281 229/110
3,937,392 A * 2/1976 Swisher ..... B65D 5/566 229/5.5

(Continued)

*Primary Examiner* — Andrew M Tecco
*Assistant Examiner* — Jacob A Smith
(74) *Attorney, Agent, or Firm* — Eugenio J. Torres-Oyola; Victor M. Rodriguez-Reyes; Rafael Rodriguez-Muriel

(57) ABSTRACT

The invention relates to a polygonal container comprising a tubular polygonal body (10) with an even number of flat faces (11) numbering more than four, which is formed by a strip of corrugated cardboard (19) rolled up at least two full turns and adhered to itself by means of lines of glue (30) transverse to the channels of the corrugated cardboard, forming a multilayer wall (13); a base body (20) defined by a base panel of cut and folded stiff double-faced corrugated cardboard (24) attached around an end portion of the tubular polygonal body (10). The method comprises forming the tubular polygonal body by means of rolling the strip of corrugated cardboard around a polygonal rotary drum (51) and subsequently attaching to a base body (20).

24 Claims, 16 Drawing Sheets

(51) Int. Cl.

| | |
|---|---|
| ***B31C 1/06*** | (2006.01) |
| ***B31C 1/08*** | (2006.01) |
| ***B65D 3/22*** | (2006.01) |
| ***B65D 5/02*** | (2006.01) |
| *B31B 110/20* | (2017.01) |
| *B31B 120/10* | (2017.01) |
| *B31B 105/00* | (2017.01) |

(52) U.S. Cl.
CPC ..... *B65D 3/22* (2013.01); *B65D 5/0227* (2013.01); *B65D 5/0281* (2013.01); *B31B 2105/0022* (2017.08); *B31B 2110/20* (2017.08); *B31B 2120/10* (2017.08)

(58) Field of Classification Search
CPC ..... B65D 5/32; B65D 5/5054; B65D 5/029; B31B 50/28; B31B 2110/20; B31B 2105/0022; B31B 2100/0022; B31B 50/62; B31B 51/28; B31C 1/06; B31C 1/083; B65B 43/265
USPC ..... 229/5
See application file for complete search history.

(56) References Cited

U.S. PATENT DOCUMENTS

| | | | | |
|---|---|---|---|---|
| 4,441,948 | A * | 4/1984 | Gillard | B31C 1/00 156/207 |
| 4,742,951 | A * | 5/1988 | Kelly | B65D 5/2033 229/4.5 |
| 2009/0233777 | A1 * | 9/2009 | Greenfield | B65D 5/0281 493/52 |

* cited by examiner

REINFORCED POLYGONAL CONTAINER MADE OF GLUED CORRUGATED LAMINAR MATERIAL, PRODUCTION METHOD AND MACHINE FOR FORMING SAME

FIELD OF THE ART

The present invention relates to a reinforced polygonal container made of glued, i.e., adhered using adhesives, corrugated laminar material formed by a tubular body attached to a base body which closes one of its ends. The present invention also relates to a production method and to a machine for forming said reinforced polygonal container by implementing the method.

The tubular body is formed by a strip of corrugated cardboard rolled up and adhered to itself, and the base body is formed by cut and folded stiff corrugated cardboard forming a polygonal base surrounded by a polygonal base wall, the end of the tubular body being inserted into the base body and attached thereto.

In relation to the term container applied to the object of this invention, it must be taken into account herein that said object provides a cardboard holder which can be used for packaging bulk products and even for transporting liquids contained in a flexible receptacle which prevents the liquid from contacting the surrounding cardboard wall.

STATE OF THE ART

Solutions consisting of corrugated cardboard or solid fiber containers or holders for containing bulk products which are furthermore capable of withstanding significant loads and heavy materials have been proposed for many years as a possible replacement of conventional metal containers, particularly steel containers, entailing a very significant cost savings both in production and in transport logistics. In that sense, patents U.S. Pat. No. 3,283,673, JP2015020747, and utility model DE7819146 can be mentioned.

Document EP0841252A2 discloses containers formed by a tubular polygonal body and a base body, both being made entirely from stiff corrugated cardboard that has been folded along fold lines, forming both the tubular body and the base body. The fold lines of said bodies are typically produced by flattening the corrugated sheets, with the thickness of the corrugated cardboard at said fold line being reduced, therefore losing stiffness and working as a hinge.

Typically, the walls of the tubular body are made of a single layer of corrugated cardboard, although in order to increase its strength, thicker corrugated cardboards provided with several smooth sheets can be used with several interposed corrugated sheets.

Containers of this type must be produced from large-sized panels of stiff corrugated cardboard that are custom made to produce a specific container or cut to adapt to the size of the desired container, generating waste.

There is also known through document U.S. Pat. No. 4,441,948 a tubular polygonal body having four sides formed from a strip of single-faced corrugated cardboard rolled up and adhered to itself. This document also describes that said tubular polygonal body is attached to a cover at one of its ends forming a container.

However, this document proposes flattening the corrugated cardboard in the corner areas to obtain a fold line which allows folding the strip of corrugated cardboard 90°, with the thickness of the wall of the tubular polygonal body being thinner in the corner areas than on the substantially flat faces, as seen in detail FIG. 3 of this document U.S. Pat. No. 4,441,948.

This document furthermore describes how the glue used for attaching the corrugated cardboard to itself is applied on the tips of the corrugated sheet, i.e., each corrugation of the corrugated sheet has glue applied on its most protruding part, forming lines of glue parallel to the channels defined by said corrugations of the corrugated sheet.

Document U.S. Pat. No. 4,601,407 describes a container formed by a strip of cardboard rolled up and adhered to itself in multiple layers. However, this document proposes flattening the corners of the cardboard to allow folding the cardboard into angles equal to or smaller than 90°, even allowing the complete folding of the cardboard, forming angles of 0° in two opposite corners. However, this solution weakens the corners by reducing the thickness thereof and requires more complex production operations. Furthermore, this prior art document proposes applying the adhesive by means of rollers, with the adhesive therefore being applied at the protruding ends of each projection forming the corrugation of the corrugated sheet, thereby creating lines of glue parallel to the corrugation and perpendicular to the bottom of the container, without there being any attachment or reinforcement perpendicular to the corrugation which may reinforce the corrugation in the direction in which it is the weakest.

Document GB479613 also describes a plant for the production of containers having a square base, formed by a strip of paper rolled up and adhered to itself in several superimposed layers on a square mandrel to which a base is attached forming a container. In this example, the laminar material used is paper, which means that it has a low strength. To improve its strength, this document proposes pressing the multiple layers of paper with a mold, producing an embossment in the form of reinforcement lines on the layers of paper which is permanently formed after the drying of the adhesive attaching said layers. This solution requires applying many layers of paper, and therefore a high cost compared with other solutions that use cardboard instead of paper. Furthermore, cardboard cannot be molded without its thickness being reduced, which would cause the weakening thereof.

In all the known prior art documents, the corner areas are flattened reducing the thickness of the wall of the tubular polygonal body in that area, and therefore weakening its axial compressive and radial tensile structural strength, and in all those documents which mention the use of single-faced corrugated cardboard, the application of glue on the tips formed by the corrugation, therefore constituting lines of glue parallel to the corrugation, is proposed.

None of the known prior art documents proposes a container made entirely of a corrugated cardboard having a structural reinforcement sufficient to withstand expansion loads and to allow lifting the container from an upper end portion, with the lower end portion being suspended.

BRIEF DESCRIPTION OF THE INVENTION

According to a first aspect, the present invention relates to a reinforced polygonal container made of corrugated laminar material comprising, according to the structure already known in the aforementioned state of the art:

a tubular polygonal body with an even number of flat faces numbering more than four defined between corner areas, the tubular polygonal body being formed by a strip of corrugated cardboard at least partially superimposed on and adhered to itself;

a base body defined by a base panel formed by cut and folded stiff double-faced corrugated cardboard defining a polygonal bottom and a polygonal base wall surrounding the polygonal bottom and perpendicular thereto, the polygonal base wall having the same number of sides as the tubular polygonal body and a inner surface of each side of the polygonal base wall being superimposed on and adhered to a lower end portion of an outer surface of the faces of the tubular polygonal body, attaching the base body around the lower end portion of the tubular polygonal body;

wherein the corrugated cardboard of the tubular polygonal body includes a corrugated sheet forming channels perpendicular to the polygonal bottom of the base body.

A container as indicated above is a container with walls and a bottom, both closed, and a wide upper opening which allows pouring bulk products into said container.

It will be understood that corrugated cardboard is that cardboard formed by smooth sheets of paper and corrugated sheets of paper adhered together. The corrugated sheets will form corrugations defining between them channels, providing the resulting cardboard with a certain thickness and structural strength.

Said channels are proposed to be perpendicular to the polygonal bottom of the base body, so the corner areas will be parallel to said channels, facilitating the formation of a certain angle in the corrugated cardboard in said corner areas, given that the corrugated sheets confer greater inertia to the corrugated cardboard in the direction of the channels, with the inertia being less in the direction transverse to the channels.

It is proposed to form from that material a polygonal container formed by a tubular polygonal body with an even number of faces numbering more than four, typically six or eight faces, with an end closed by means of a base body adhered to the end portion of the tubular body.

Containers of this type are provided for containing products in the form of liquid, paste, powder, grain, or in dispersed units, in the case of liquids and in other cases with the aid of a plastic bag inserted into the mentioned container which can be hermetically sealed. These forms of material behave largely like a liquid, so they generate an outwardly radial pressure on the walls of the container, said pressure increasing at the base.

The optimum shape for withstanding said stresses is by means of a cylindrical container which uniformly distributes said stresses, subjecting the wall of the container to pure tensile stress by way of a ring. However, the cylindrical shape is rather inefficient for storing a large amount of containers, since it generates many interspaces and greatly complicates the strong attachment of the cylindrical tubular body with a base body if said base body is to be obtained from flat corrugated cardboard cutting and folding operations.

These problems are solved by using a polygonal geometric shape similar to a cylinder, in this case a tubular polygonal body with an even number of faces numbering more than four, as shown in the mentioned prior art documents, is proposed.

With the number of flat faces being, for example, six or eight, hexagonal or octagonal containers which can be regular, i.e. with all their faces having the same length, or irregular, for example, with faces having two different alternating lengths, are obtained. Hexagonal or octagonal containers exhibit greater strength than square containers, particularly against the expansion force that may be produced by a liquid, pasty, or granular product contained inside same, due to the fact that the length of the side faces in hexagonal and octagonal containers is shorter than in square containers of equivalent volume. The compressive strength also improves given that each corner area acts as a reinforcement column, and by increasing the number of said corner areas, the reinforcement columns and therefore the load the container can withstand under compression are increased.

Said hexagonal and octagonal geometries furthermore allow better space utilization by grouping multiple containers in comparison with other polygonal shapes such as a pentagon, although the octagonal solution is preferred for maximizing the utilization of the square space existing on a pallet.

The production of a base body including a polygonal bottom surrounded by a polygonal base wall based on the cutting and folding of flat corrugated cardboard has thus been proposed. Placing the polygonal base wall around a lower end portion of the tubular polygonal wall reinforces the strength of the container against radial expansion stresses precisely at the base thereof, where said stresses are higher.

Despite choosing an optimum configuration, the tensile and bending strength of the tubular body in the radial expansion direction will be a determining factor if large-sized containers capable of storing dense products or in a large amount are to be produced.

Typically, the production of the tubular body by means of a layer of very thick corrugated cardboard, resorts to several corrugated sheets therein or the use of plastic or metal bands surrounding the container for reinforcement thereof, but this complicates recycling of the tubular body.

In a manner not known in the existing state of the art, the present invention proposes for the strip of corrugated cardboard of the tubular polygonal body to be rolled up at least two full turns and adhered to itself by means of lines of glue transverse to the channels of the corrugated sheet, forming a multilayer wall.

In other words, it is proposed to roll up the corrugated cardboard at least two full turns, obtaining a tubular polygonal body with a wall formed by at least the superimposition of two layers of corrugated cardboard, with an end portion of said tubular polygonal body being inserted into a base body and adhered thereto.

The different superimposed layers of corrugated cardboard will be adhered together by means of parallel lines of glue arranged in a direction transverse to the channels defined by the corrugated sheets of the corrugated cardboard. Preferably, the lines of glue will be perpendicular to the channels.

It must be borne in mind that the channels of said corrugated cardboard will be perpendicular to the polygonal bottom of the base body, therefore the lines of glue will preferably be parallel to said polygonal bottom of the base body.

The channels will offer structural strength in a direction perpendicular to the polygonal bottom, which allows withstanding, for example, compressive stresses of the tubular polygonal body caused by the stacking of several containers or other pressure loads on the container, whereas the lines of glue will offer structural reinforcement with respect to radial expansion stresses of the container, said lines of glue forming rings of glue around the container, operating like belts, which will increase the structural strength thereof.

Furthermore, manufacturing the tubular polygonal body by means of rolling a strip of corrugated cardboard forming a multilayer wall allows adapting the strength of the container by modifying the number of layers of the tubular polygonal body, depending on the intended use thereof, in an easy manner without having to modify the corrugated cardboard used.

This solution therefore provides great versatility, which allows producing a wide range of containers with different strengths and costs, all produced with one and the same material and with one and the same system, without generating wasted cardboard, and therefore optimizing costs.

The strip is adhered to itself by means of lines of glue transverse to the corrugation of the corrugated cardboard, preferably parallel to the polygonal bottom of the base body. This allows, while at the same time rolling up the corrugated cardboard, beads of glue to be gradually deposited in predefined areas, along one of the surfaces thereof to cause the adhesion, resulting in a simplified production process and a reinforced tubular polygonal body as a result of the lines of glue being transverse to the corrugation.

According to an embodiment of the first aspect of the invention, the lower end portion of the tubular polygonal body, around which the polygonal base wall of the base body is adhered and superimposed, includes at least part of the mentioned lines of glue which attach the strip of corrugated cardboard to itself. In other words, in that area of the container in which the tubular polygonal body is inserted into the base body, the tubular polygonal body will have lines of glue attaching the strip of corrugated cardboard to itself.

This feature reinforces the area of the tubular polygonal body to which the base body is adhered, thereby providing reinforced structural strength which even allows lifting the container by pulling from its upper end portion, with the lower end portion being held under traction supporting the weight of the contents of the container.

It is also contemplated that the corrugated cardboard forming the tubular polygonal body is single-faced corrugated cardboard provided only with one smooth sheet and one corrugated sheet.

Single-faced corrugated cardboard is that cardboard formed from a smooth sheet on which a corrugated sheet is adhered. The result is cardboard with a certain thickness which can be folded and rolled following the direction of the corrugation, but having certain bending strength in a direction transverse to the corrugation.

Since it is flexible, single-faced corrugated cardboard allows storing a rolled-up strip of significant length, whereby one or more tubular polygonal bodies can be produced. Furthermore, rolling up single-faced corrugated cardboard allows increasing or reducing the number of turns that said single-faced corrugated cardboard makes around itself, thereby modifying the final strength of the tubular polygonal body and adjusting the costs thereof.

Alternatively, it is contemplated that the strip of corrugated cardboard forming the tubular polygonal body is one panel or several successive panels with adjacent ends of stiff double-faced corrugated cardboard, with the corner areas being formed by folds of the strip of corrugated cardboard.

Stiff double-faced corrugated cardboard is cardboard formed by more than two sheets, for example by three sheets, two smooth sheets and one interposed corrugated sheet, or by five sheets, three smooth sheets and two sandwiched corrugated sheets, or by more sheets. The result is stiff cardboard that cannot be folded or rolled unless a fold line is made by flattening the corrugated sheet or sheets, or cutting some of the sheets.

Therefore, the strip of corrugated cardboard can be formed by a single panel of double-faced corrugated cardboard, which will be folded and rolled up forming the tubular polygonal body. Given that a considerable length of corrugated cardboard will be required to form a tubular polygonal body with at least two layers of corrugated cardboard, it is contemplated that the strip of corrugated cardboard is formed not by a single panel but by several successively arranged coplanar panels of corrugated cardboard, with their respective end edges being adjacent. Once the strip of corrugated cardboard has been rolled up and adhered to itself, the divisions between panels are integrated in the tubular polygonal body without this entailing notable weakening of the structural strength thereof.

It is also contemplated that the length of the strip of corrugated cardboard is equal to several times the perimeter of the tubular polygonal body plus an overlapping area equal to or less than the length of a face of the tubular polygonal body or comprised between 5 cm and 15 cm. This allows assuring the same number of layers of single-faced corrugated cardboard along the entire perimeter of the tubular polygonal body, except in the initial and final area of the strip, where there will be a small overlap reinforcing that area.

Preferably, the thickness of the multilayer wall on said flat faces will be the same as the thickness in the corner areas, allowing the corner areas to better withstand stresses compared with other solutions in which the corner areas are flattened.

As a result of this feature, the resulting tubular polygonal body will have uniform thickness and strength along its entire perimeter, which are the same on the flat faces and in the corner areas, both against compressive stresses of said tubular polygonal body and against radial stresses exerted form inside or outside said tubular polygonal body.

This allows reducing the thickness of the multilayer wall keeping the strength properties of the container, achieving material savings as well as very favorable repercussions on economic and ecological aspects.

In a container provided with an even number of flat faces numbering more than four, the angle that two contiguous flat faces of the tubular polygonal body form with respect to one another is greater than 90°, such that the corner area can more readily adopt said angle without causing the flattening of the corrugated cardboard, respecting the radius of curvature of the corrugated cardboard for adaption to a corner area which may be insufficient in a 90° angle.

The base body comprises a polygonal base and a polygonal base wall. It is proposed for said base body to be obtained from a flat base panel cut and folded until obtaining the described base body.

It is proposed for each of the sides of the polygonal base wall to be obtained from lateral parts connected to the polygonal bottom by means of fold lines working like hinges. At least some of the mentioned lateral parts will have flaps connected thereto by means of fold lines also working like hinges.

The folding of the lateral parts and flaps will allow forming the polygonal base wall, adhering the flaps to the adjacent lateral parts by means of lines of glue parallel to one another in the flat layout of the base body, forming a closed envelopment that completely surrounds the end portion of the tubular polygonal body.

Therefore, the polygonal base wall will preferably form a closed envelopment, such that said polygonal base wall can also withstand axial stresses as a result of the formation of a closed polygonal ring around the base of the tubular polygonal body.

It will be understood that the flat layout is the shape of the base panel before the folding of the lateral parts and flaps.

The flat layout of the base body therefore corresponds to the corrugated cardboard from which the die-cut base body is obtained before folding, i.e., to the dismantling of the adhered attachments between the flaps and polygonal base wall and its flattened extension.

It is also proposed for a cover body to be attached to an end of the tubular polygonal body opposite the end attached to the base body, the cover body preferably being identical to the base body.

The multilayer wall of the tubular polygonal body will typically consist of between 3 and 7 layers of corrugated cardboard. This number of layers allows adapting the strength of the container to different requirements, as appropriate, using corrugated cardboard of one and the same thickness and size at all times, simply adapting the number of layers.

According to a second aspect, the present invention relates to a method of forming reinforced polygonal containers which comprises the following steps:

forming a tubular polygonal body made of corrugated cardboard;

feeding stiff double-faced corrugated cardboard defined by a base panel formed by a polygonal bottom surrounded by lateral parts and flaps forming a polygonal base wall with the same number of sides as the tubular polygonal body, the lateral parts being connected to the polygonal bottom by means of fold lines and the flaps being connected to the lateral parts by means of fold lines;

applying lines of glue parallel to one another on areas of the base panel;

positioning the base panel adjacent to and centered with a lower end portion of the tubular polygonal body, closing said lower end portion with the polygonal bottom;

folding the lateral parts and flaps of the base panel along the fold lines by pressing them against an outer surface of said lower end portion of the tubular polygonal body forming and adhering the resulting polygonal base wall around the end portion of the tubular polygonal body.

These steps of the method are known per se and allow obtaining a container having a polygonal base made entirely of cardboard, therefore having a low cost and being readily recyclable.

The base body will be formed entirely from a single base panel which, duly cut and folded, will allow forming the polygonal bottom integral with a polygonal base wall which forms a continuous envelopment that has been obtained by means of the lateral adhesion of multiple lateral parts by means of flaps.

Each lateral part will be attached in continuity with a lateral edge of the polygonal bottom through a fold line, these elements being formed form one and the same base panel. Likewise, flaps will be attached in continuity with side edges of the mentioned lateral parts through a fold line, said flaps being sandwiched between adjacent lateral parts in the flat layout of the base panel, and these elements being formed from one and the same base panel.

The folding of the lateral parts with respect to the polygonal bottom through the fold line until forming a 90° angle, as well as the folding of the flaps until being superimposed on an adjacent lateral part and adhered thereto, will allow forming the polygonal base wall.

The flaps can be superimposed on the outer surface of the lateral parts, with the inner surface of all the lateral parts contacting the lower end portion of the tubular polygonal body, or alternatively the flaps can be adhered to the inner surface of some of the lateral parts and simultaneously to the outer surface of the lower end portion of the tubular polygonal body.

Unlike what has been previously disclosed, the present invention proposes, in a manner not known in the existing state of the art, for the step of forming the tubular polygonal body to comprise:

retaining an end edge of a strip of corrugated cardboard on a polygonal rotary drum with an even number of flat facets numbering more than four, the channel of the corrugated sheet included in the strip of corrugated cardboard being parallel to an axis of rotation of the polygonal rotary drum;

applying lines of glue parallel to one another and transverse to the channels on a face of the strip of corrugated cardboard;

supplying the strip of corrugated cardboard in a forward movement direction transverse to the channels while at the same time rotating the polygonal rotary drum around the axis of rotation at least two full turns, causing the rolling of the strip of corrugated cardboard around same, forming a tubular polygonal body with a multilayer wall;

releasing the end edge and extracting the tubular polygonal body from the polygonal rotary drum.

This method therefore allows obtaining a tubular polygonal body formed by a strip of corrugated cardboard rolled up and adhered to itself by means of lines of glue transverse to the channels of the corrugated cardboard, thereby obtaining a container having improved strength.

Preferably, the formation and adhesion of the polygonal base wall around the end portion of the tubular polygonal body is performed before the extraction of the tubular polygonal body from the polygonal rotary drum, such that the polygonal rotary drum can act as a plate against which the parts of the base body forming walls to be adhered around the tubular polygonal body press.

It is proposed for the base panel to be positioned with respect to the tubular polygonal body by means of movement in a direction perpendicular to the axis of rotation of the polygonal rotary drum and parallel to the direction of the lines of glue which are applied on said base panel while it moves, before folding.

Likewise, it is contemplated that the lines of glue applied on the strip of corrugated cardboard are applied at the same time as the rolling of said strip of corrugated cardboard, said lines of glue therefore being parallel to the forward movement direction of the strip of corrugated cardboard.

According to an embodiment of the present invention, the lines of glue applied on the strip of corrugated cardboard and/or the lines of glue applied on the base panel combine lines of cold glue and lines of hot glue.

Hot glue is hot-applied molten glue which produces adhesion very quickly upon cooling. In contrast, cold glue is glue applied at a lower temperature than hot glue, or even at room temperature, and offers a stronger adhesion than that provided by hot glue after drying, but has a slower, and therefore longer, drying process.

Combining both types of glue allows quick assembly of the container which remains assembled as a result of the quick hardening of the hot glue, thereby speeding up the production process and increasing productivity. After assembly, the hot glue keeps the container assembled while the cold glue hardens.

The end result will have the strength advantages of cold glue and production speed advantages of hot glue.

The resulting container will therefore have lines of hardened glue of both types of adhesives.

It will be understood that the terms hot glue and cold glue refer to the types of glue known in the sector and recognizable by a skilled person even after solidification and at room temperature.

According to a third aspect, the present invention relates to a forming machine for forming reinforced polygonal containers such as those described above by applying the method described above. The proposed machine includes, in a manner known in the state of the art:

a tubular polygonal body forming station configured for holding a tubular body in a holding position;

a base body forming station comprising:

a supplier device for supplying base panels in a supply direction through a supply passage to an assembly position adjacent to an end of the holding position;

an applicator device for lines of glue configured for applying lines of glue on a base panel as it moves in the supply direction;

a folder device consisting of multiple folder units arranged around the assembly position, each being movable between a standby position in which they interfere with neither the supply passage nor the assembly position, and a folding position in which the folding units interfere with the assembly position and are surrounding the holding position, causing the folding of parts of a base panel located in the assembly position by pressing them against an end portion of a tubular polygonal body located in the holding position.

Therefore, the tubular polygonal body forming station is in charge of forming a tubular polygonal body and holding same in the holding position while the base body forming station is in charge of forming a base body, attaching it to a lower end portion of the tubular polygonal body held in the holding position.

The base body forming station moves a base panel through a supply passage applying lines of glue on specific areas of the base panel while doing so. When the base panel reaches the assembly position located right below and facing the holding position, the folder device folds parts of the base panel to convert said parts into a polygonal base wall forming a continuous closed envelopment around the lower end portion of the tubular polygonal body formed and held in the holding position. The result is a complete container.

In a manner not known in the known state of the art, the tubular polygonal body forming station according to the principles of this invention is proposed to include:

a polygonal rotary drum with an even number of flat facets numbering more than four defining the holding position and including a releasable fixing device for fixing an end edge of a strip of corrugated cardboard, said polygonal rotary drum being connected to a cantilevered rotating shaft operated by means of a driving member;

a supplier device for supplying the strip of corrugated cardboard in a forward movement direction transverse to the axis of rotation of the polygonal rotary drum;

an applicator device for lines of glue consisting of a bridge of applicators of lines of glue configured for depositing lines of glue on a face of the strip of corrugated cardboard as it moves in the forward movement direction.

This tubular polygonal body forming station will provide a tubular polygonal body obtained from a strip of corrugated cardboard that is rolled up with lines of glue transverse to the channels of the corrugated cardboard, providing increased strength.

The proposed machine furthermore includes a formed polygonal container extraction station comprising:

a retraction device of the polygonal rotary drum configured for reducing the cross-section thereof; and an extractor device configured for moving the polygonal rotary drum in a direction parallel to the axis of rotation for the extraction thereof from the inside of the formed container.

The polygonal container extraction station allows reducing the cross-section of the polygonal rotary drum, allowing the extraction thereof from the inside of the recently formed container by means of retraction.

Additionally, it is contemplated that each applicator device for lines of glue of the polygonal tubular body forming station and/or of the base body forming station includes a combination of cold glue and hot glue applicators. As indicated above, the cold and hot glue provide different advantages which add up when combined.

It is also contemplated that the proposed machine includes a hold-down member located at the end of a pivoting arm modifying the distance between the hold-down member and the center of the polygonal rotary drum, between a pressure position in which the hold-down member presses the strip of corrugated cardboard against the polygonal rotary drum, adapting the position of the hold-down member to the polygonal contour of the polygonal rotary drum as it rotates, and a standby position separated from the strip of corrugated cardboard and from the polygonal rotary drum. This allows assuring proper rolling of the strip of corrugated cardboard around the polygonal rotary drum.

Additionally, the machine can furthermore include a retractable shaft coaxial to the center of the polygonal rotary drum, said retractable shaft being movable, by means of a retractable shaft actuator, between a coupled position in which it rotatably connects the cantilevered end of the polygonal rotary drum to a support chassis, and a decoupled position in which it disconnects said cantilevered end of the polygonal rotary drum from the mentioned chassis.

This allows supporting certain tension while keeping the polygonal rotary drum held at its two ends during the operations of unwinding the strip of corrugated cardboard, and it also allows the polygonal rotary drum to be arranged in cantilever fashion in certain moments in which operations of rolling the strip of corrugated cardboard do not have to be performed, which allows freeing up a supply passage below the polygonal rotary drum for the insertion of a base panel therethrough, allowing the folding thereof around the lower end portion of the tubular polygonal body recently formed around the polygonal rotary drum. In this manner, the polygonal rotary drum itself can act as a plate against which parts of the base panel can be folded and pressed around the tubular polygonal body to form the base body and to attach same to the rest of the container.

It will be understood that references to geometric position, such as for example, parallel, perpendicular, tangent, etc., allow deviations of up to ±5° with respect to the theoretical position defined by said nomenclature.

Other features of the invention will become apparent in the following detailed description of an embodiment.

BRIEF DESCRIPTION OF THE DRAWINGS

The foregoing and other advantages and features will be better understood based on the following detailed description of an embodiment in reference to the attached drawings which must be interpreted in an illustrative and non-limiting manner, in which.

DETAILED DESCRIPTION OF AN EMBODIMENT

Figure 1:
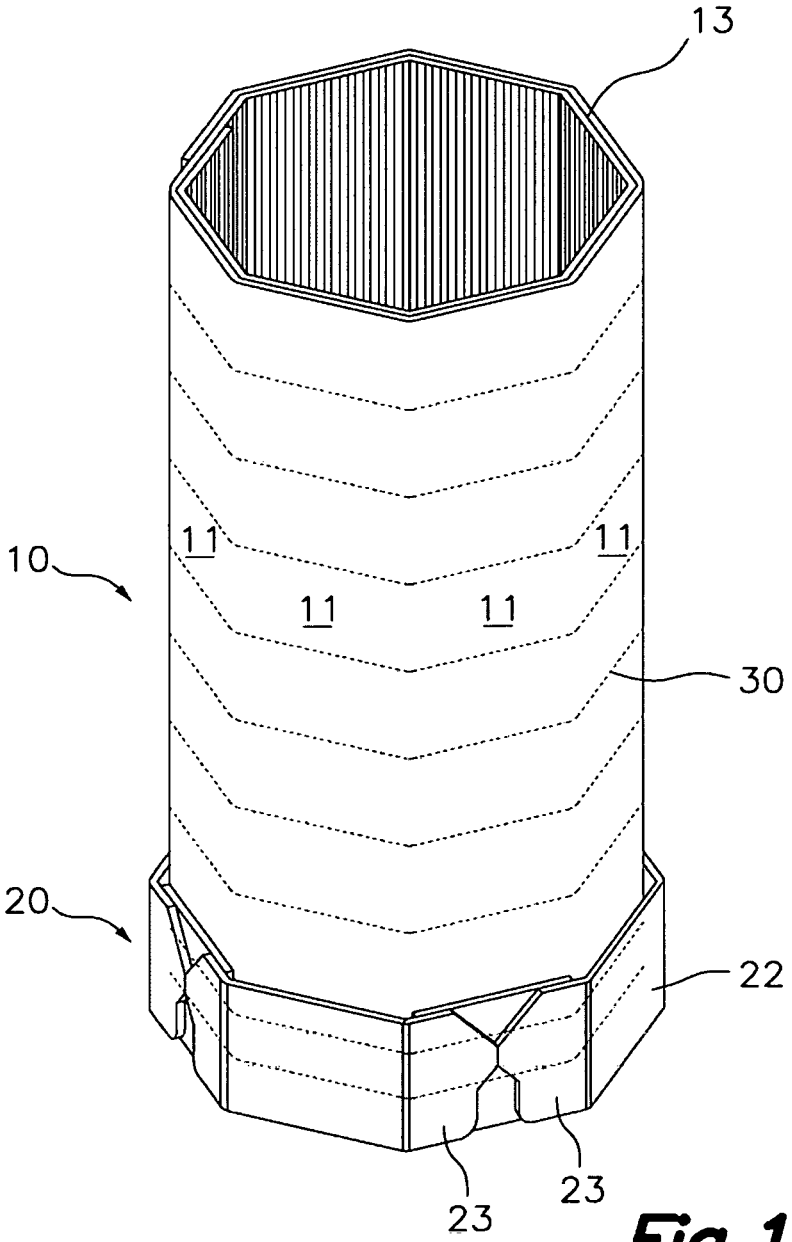
FIG. 1 shows a perspective view of the proposed container provided with a tubular octagonal polygonal body and a complementary base body attached thereto, according to an embodiment in which the corner areas of the tubular polygonal body are rounded on the outer surface thereof, with the lines of glue attaching the layers forming said tubular polygonal body to one another being indicated with a discontinuous line in this figure.

The attached drawings show illustrative, non-limiting embodiments of the present invention.

According to a first aspect, the present invention relates to a container formed by a tubular polygonal body 10 attached to a body 20, both made of corrugated cardboard.

Corrugated cardboard is that cardboard made from a combination of smooth sheets 15 attached with adhesive to corrugated sheets 16, i.e., folded sheets forming a corrugation in the form of parallel channels. The result is a cost-effective and recyclable material that is furthermore light-weight and strong.

Single-faced corrugated cardboard 14 is that formed by only one smooth sheet 15 adhered to one corrugated sheet 16, resulting in a material that has certain compressive strength and bending strength in the direction of the corrugation but is flexible in the other direction, therefore being a rollable material. This allows producing strips of corrugated cardboard 19 of a significant length and storing and transporting them in an easy and cost-effective manner in a rolled-up position.

Stiff corrugated cardboard 24 is that corrugated cardboard formed by at least two smooth sheets 15 with at least one interposed corrugated sheet 16 adhered to the two smooth sheets 15, forming double-faced corrugated cardboard. A triple-faced corrugated cardboard, quadruple-faced corrugated cardboard, etc., is obtained by adding more smooth sheets 15 and more corrugated sheets 16 to the assembly.

Unlike single-faced corrugated cardboard 14, stiff corrugated cardboard 24 is stiff and resistant to bending and compression in all directions, forming flat panels.

The tubular polygonal body 10 of the proposed container is a body in the shape of a hollow tube, having two open ends and a polygonal section defined by an even number of substantially flat faces 11 numbering more than four, for example six or eight faces 11, each comprised between two corner areas 12.

According to a first embodiment, the tubular polygonal body is produced with a strip of corrugated cardboard 19 that is single-faced corrugated cardboard 14, with the aforementioned advantages in terms of storage and handling. This reduces logistics costs as well as the waste for the production of tubular polygonal bodies 10 in comparison with other solutions based on stiff corrugated cardboard 24.

Two adjacent faces 11 form an angle with respect to one another in the mentioned corner area 12. With the number of faces 11 being an even number of more than four, it is assured that the angle that said faces form with respect to one another is an obtuse angle, preferably greater than 120°, in addition to obtaining a tubular body with a greater strength against the hydrostatic pressure that a liquid, pasty, or granular product stored therein may exert on said tubular polygonal body 10 in comparison with a container with four sides.

The inclusion of an even number of faces facilitates the possibility of grouping a plurality of containers, optimizing space and maximizing density during transport.

The proposed tubular polygonal body 10 is formed by a strip of single-faced corrugated cardboard 14 rolled up at least two times around a hollow polygonal interior and adhered to itself, obtaining a tubular polygonal body 10 defined by a multilayer wall 13 surrounding a hollow interior.

Said multilayer wall 13 of the container can be produced with a number of layers adapted to the strength or economic needs of each case, i.e., tubular polygonal bodies 10 of different strengths and prices can be produced by simply superimposing more or fewer layers of single-faced corrugated cardboard layer 14 that is rolled up. This allows obtaining a wide variety of containers with different performances and prices with the same materials and processes.

In contrast, the base body 20 will be formed by a stiff corrugated cardboard 24 which offers the strength required for this use.

The proposed base body 20 is formed by a polygonal bottom 21 surrounded by a polygonal base wall perpendicular to said polygonal bottom 21. Both the polygonal bottom 21 and the polygonal base wall will have a number of sides equal to the number of faces of the tubular polygonal body 10, and their size and proportion will be complementary to those of the tubular polygonal body 10.

The polygonal bottom 21 is placed coinciding with one of the open ends of the tubular polygonal body 10, with the polygonal base wall surrounding and contacting a lower end portion of the multilayer wall 13 of the tubular polygonal body 10 adjacent to said open end.

Figure 6:
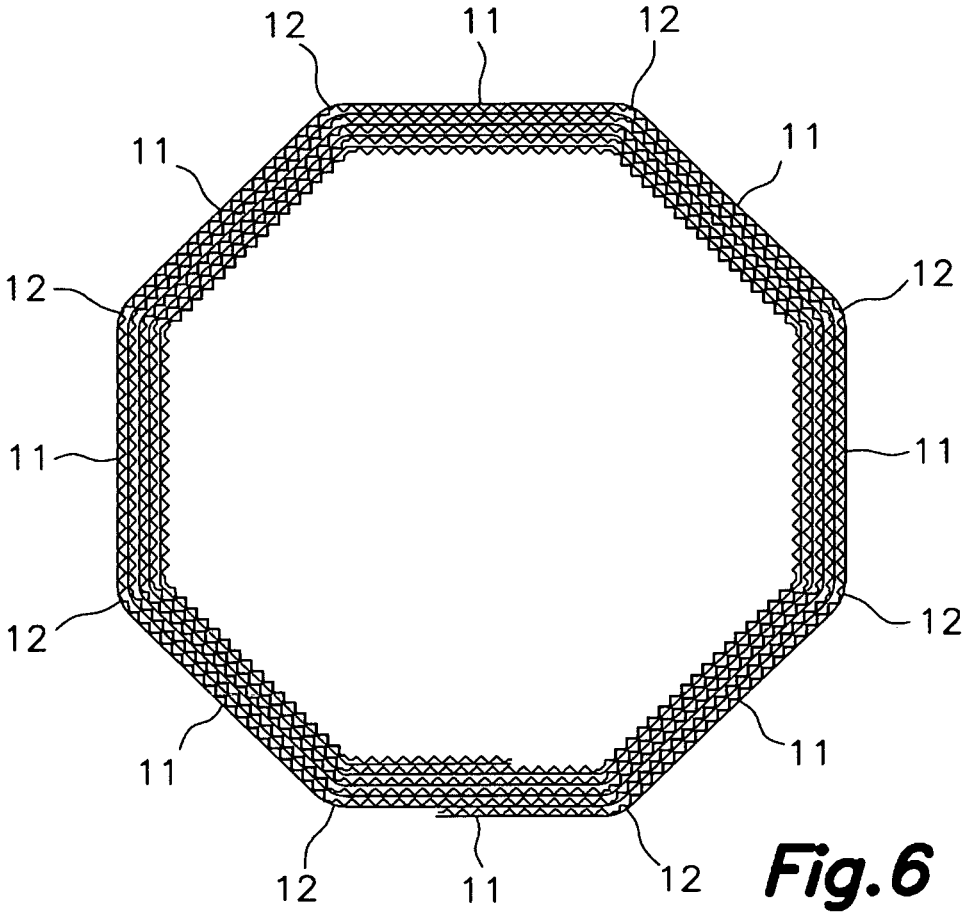
FIG. 6 shows a view equivalent to that shown in FIG. 4 but with four layers of single-faced corrugated cardboard in the entire perimeter, furthermore including an overlap of between 5 cm and 15 cm on one of the sides thereof.
Figure 7:
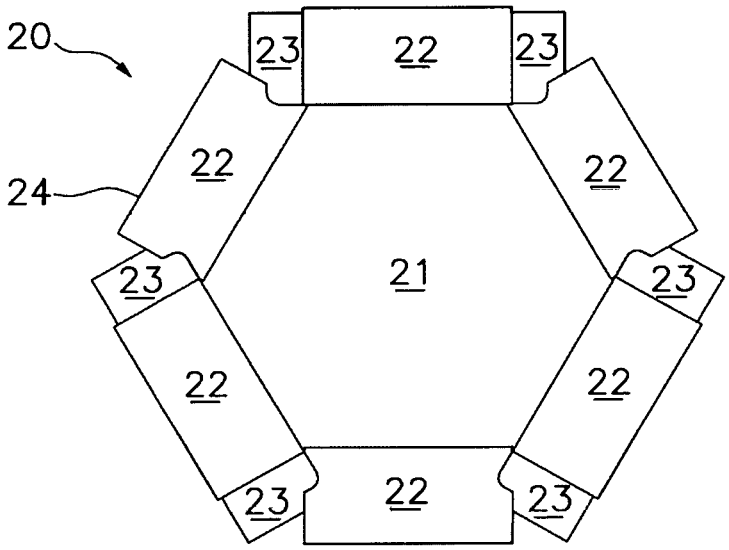
FIG. 7 shows a plan view of the panel made of cut laminar material which forms the base body before being folded, corresponding to the die-cut stiff corrugated cardboard from which the base body is obtained, according to an embodiment in which the container is hexagonal.

The base body 20 will be formed from a cut and folded single base panel 18 of stiff corrugated cardboard 24 to form the described base body 20, as shown in FIGS. 6 and 7.

Preferably, each face of the polygonal base wall is formed by lateral parts 22 extending from one of the sides of the polygonal bottom 21, defining between both a fold line, and each lateral part 22 of the polygonal base wall is attached to the other adjacent lateral parts after the folding thereof by means of flaps 23 which are attached in continuity by means of fold lines to some of said lateral parts 22, the polygonal base wall as a whole forming a closed envelopment around the end of the tubular polygonal body 10 which allows reinforcing said end.

FIGS. 7 to 10 show different embodiments in which lines of glue parallel to one another have been applied on different areas of the stiff corrugated cardboard 24. The application of all the lines of glue parallel to one another allows said lines of glue to be applied by means of a bridge of applicators, moving the stiff corrugated cardboard 24 below said bridge in a forward movement direction parallel to the lines of glue to be deposited. The individual control of each glue applicator allows the precise deposition thereof in the desired areas.

After folding the stiff corrugated cardboard 24, the lines of glue applied on the flaps 23 will attach the inner surface of said flaps 23 where the lines of glue have been deposited to the outer surface of the polygonal base wall, thereby forming the base body 20.

Figure 8:
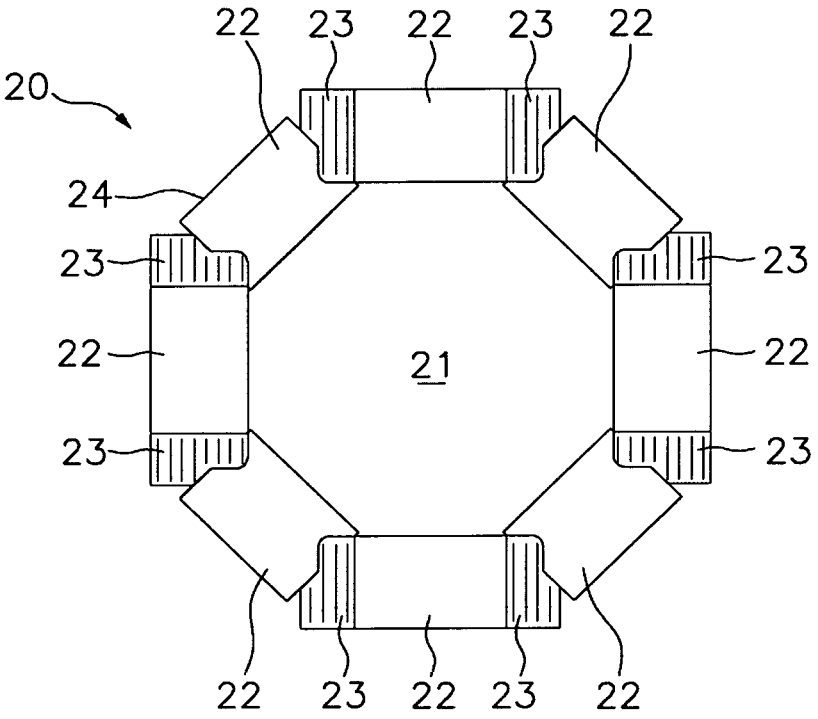
FIG. 8 shows a plan view of the panel made of cut laminar material which forms the base body before being folded, corresponding to the die-cut stiff corrugated cardboard from which the base body is obtained, according to an embodiment in which the container is octagonal. This figure also includes parallel lines corresponding to lines of glue applied on areas corresponding to the flaps of the base body, intended for being superimposed and adhered by means of the mentioned lines of glue to the outer surface of the areas corresponding to the polygonal base wall of the base body, thereby forming the base body.
Figure 9:
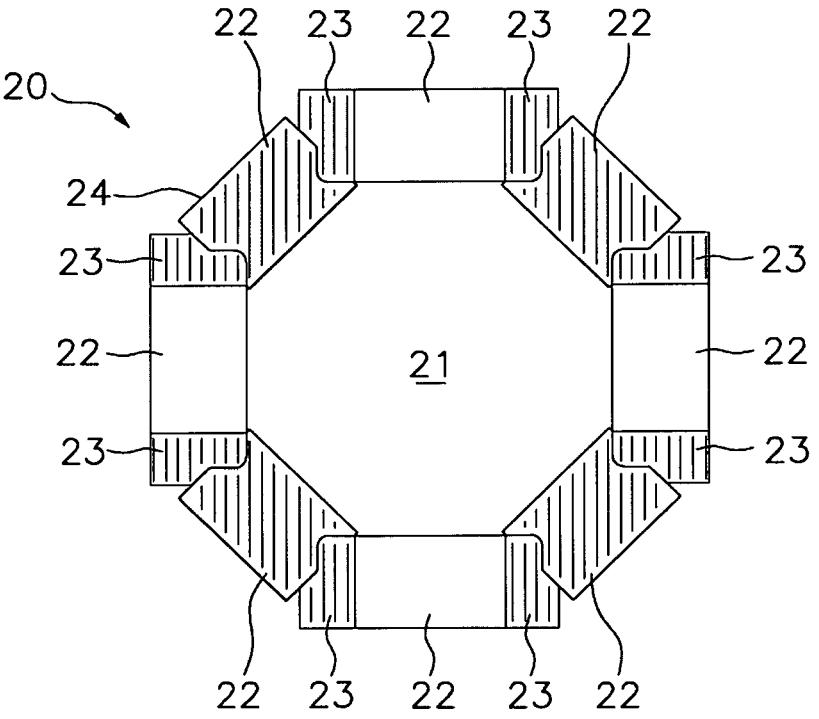
FIG. 9 shows the same as FIG. 8 but furthermore including lines of glue in alternating areas corresponding to the polygonal base wall of the base body, thereby allowing not only the formation of the base body but also the adhesion thereof to the outer surface of the tubular polygonal body forming the container.
Figure 10:
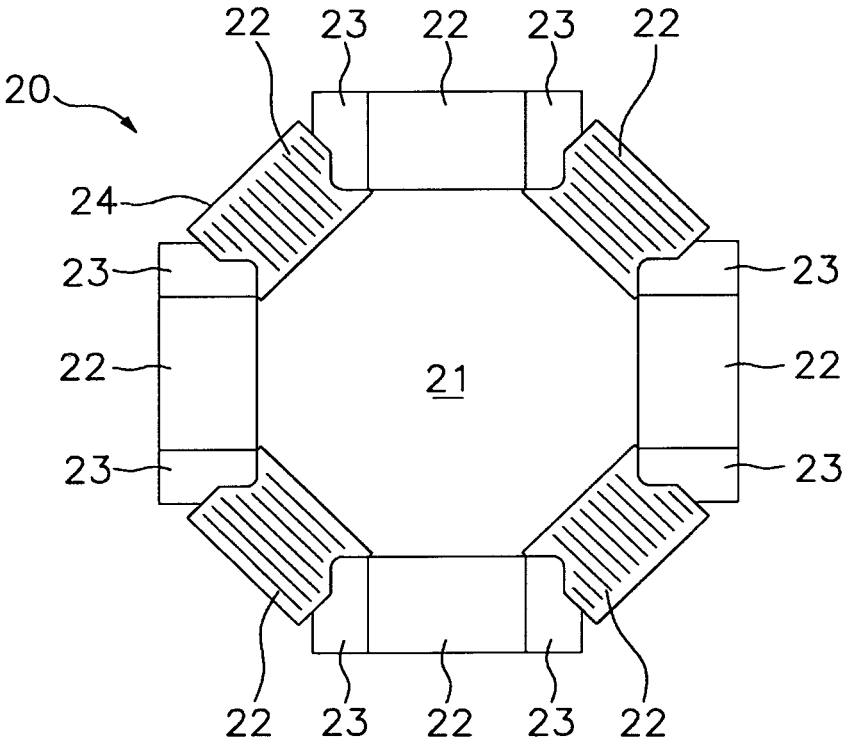
FIG. 10 shows an alternative view to FIG. 8 in which the areas corresponding to the flaps of the base body which also receive lines of glue are areas different from those proposed in the embodiment of FIG. 8.
Figure 11:
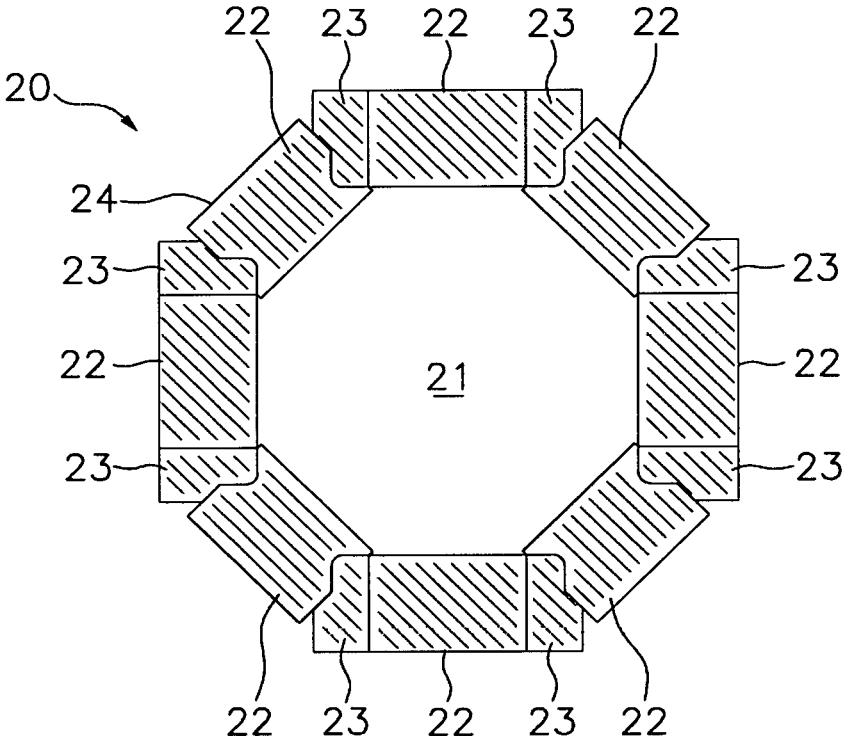
FIG. 11 shows the same as FIG. 10 but furthermore including lines of glue in all the areas corresponding to the polygonal base wall of the base body, which thereby allows both adhering the flaps to the outer surface of the polygonal base wall and adhering the polygonal base wall to the outer surface of the tubular polygonal body.
Figure 12:
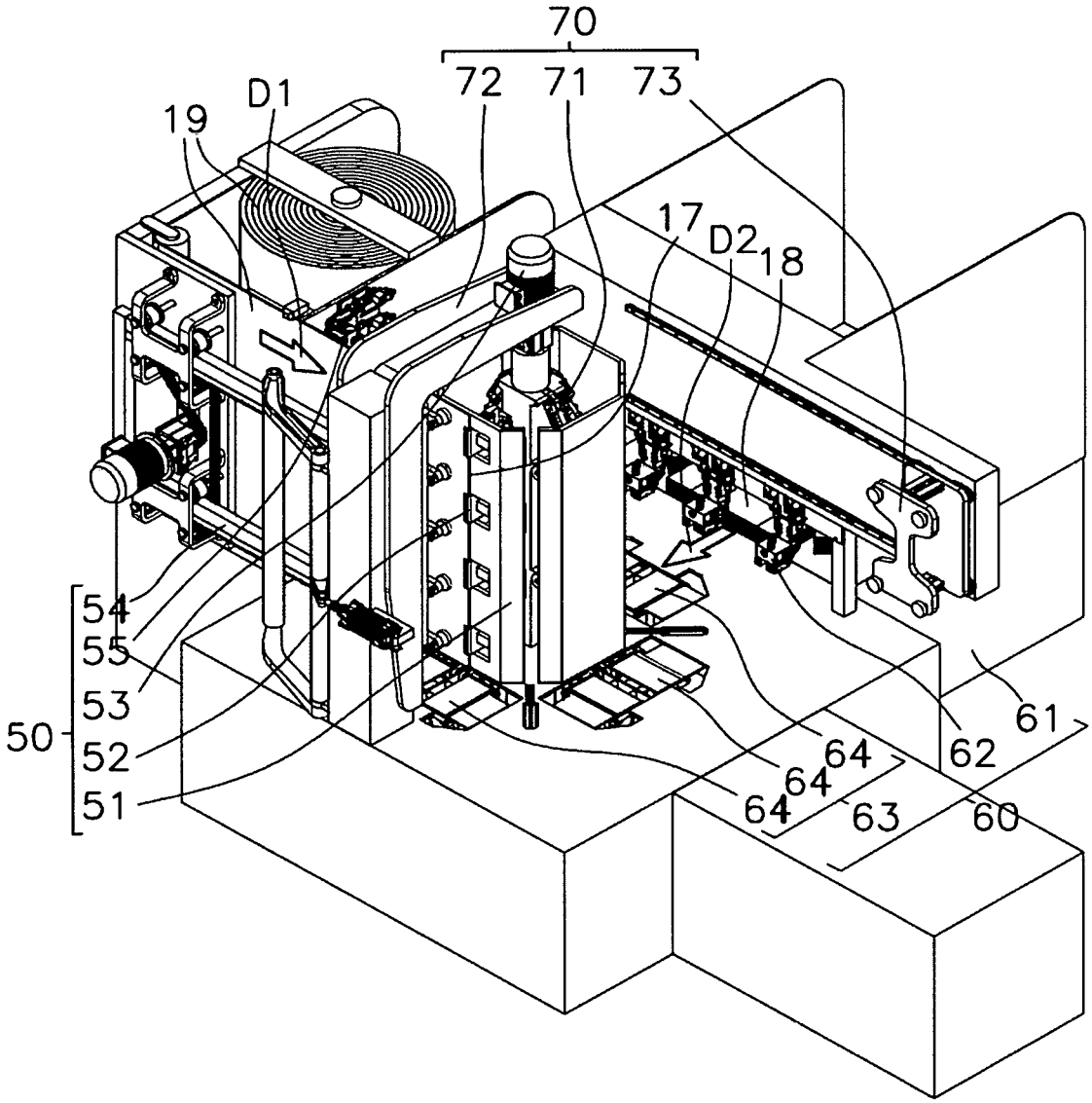
FIG. 12 shows a perspective view of a container forming machine according to a first embodiment in which the tubular polygonal body is produced with a strip of flexible single-faced corrugated cardboard that is stored, rolled, and supplied by means of a supplier device for supplying the strip of corrugated cardboard to a tubular polygonal body forming station, an initial step of the method in which the tubular polygonal body is still not formed, but in which an end edge of the strip of corrugated cardboard has been retained on the polygonal rotary drum being shown in this figure.
Figure 13:
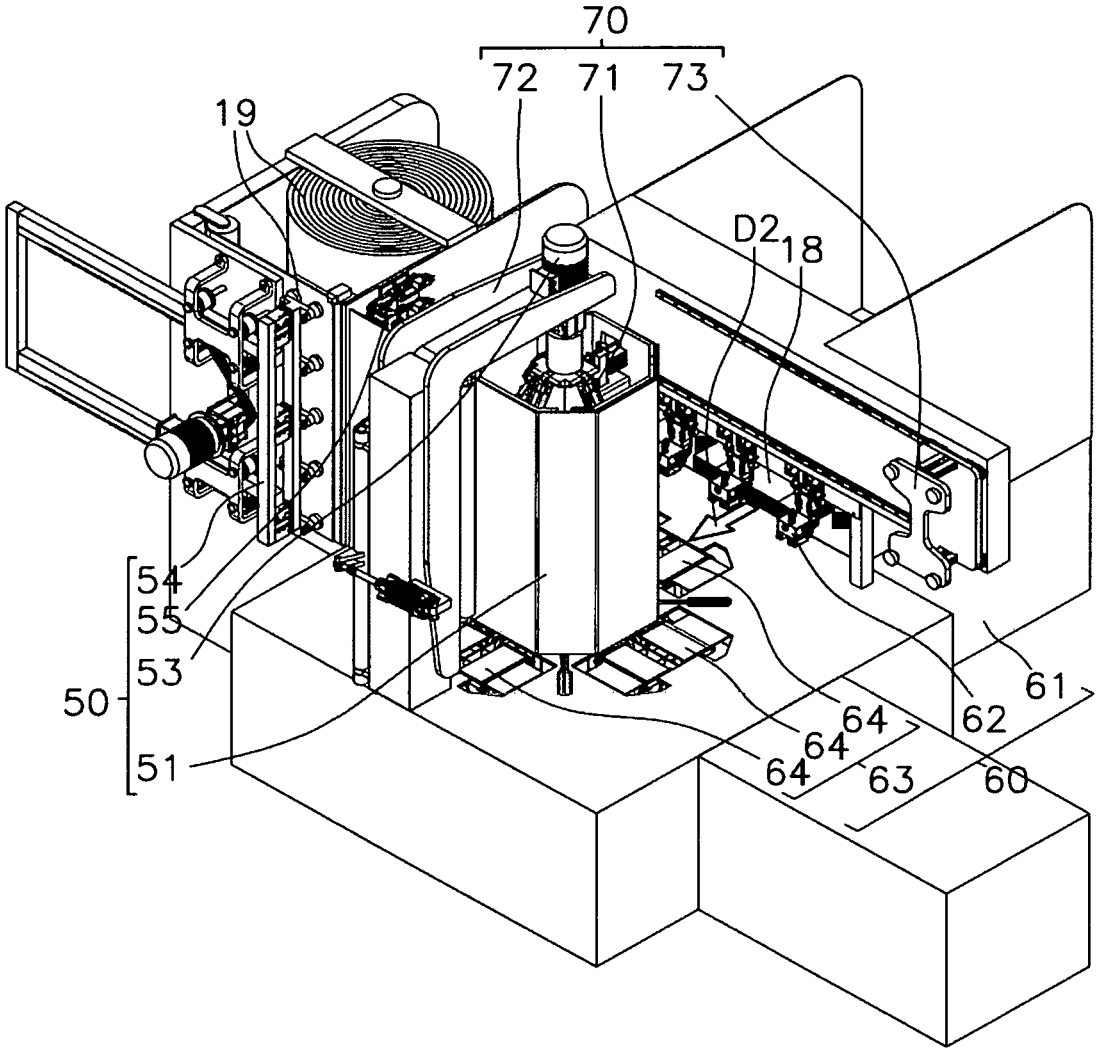
FIG. 13 shows the same view as FIG. 12 but in a subsequent step of the method in which the tubular polygonal body has already been formed around the polygonal rotary drum by means of the rotation thereof.
Figure 14:
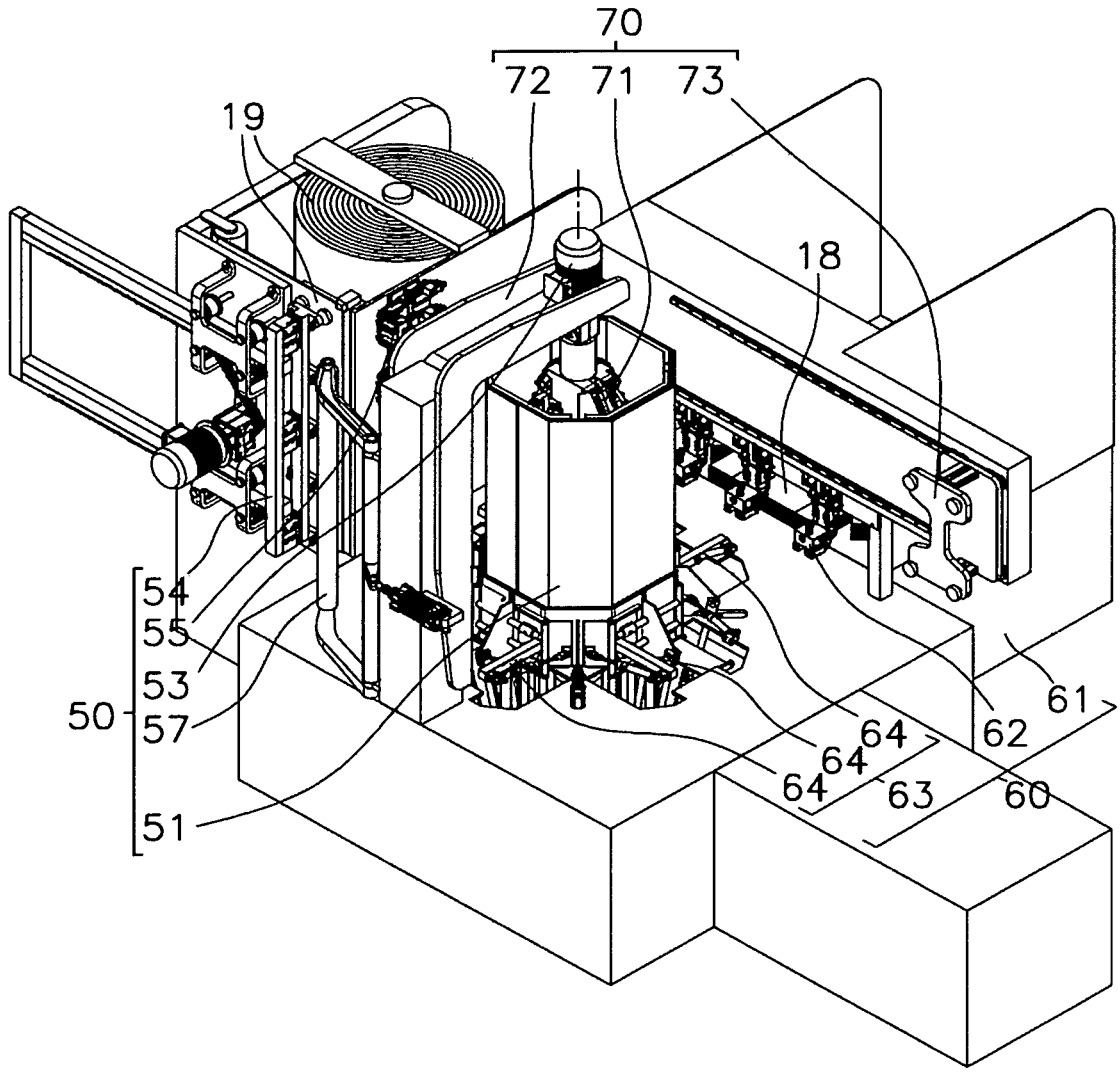
FIG. 14 shows the same view as FIG. 13 but in a subsequent step of the method in which a base panel has been placed in the forming position, below and centered with the recently formed tubular polygonal body, and in which the folder device has folded parts of the base panel around a lower end portion of the tubular polygonal body forming the base body.
Figure 15:
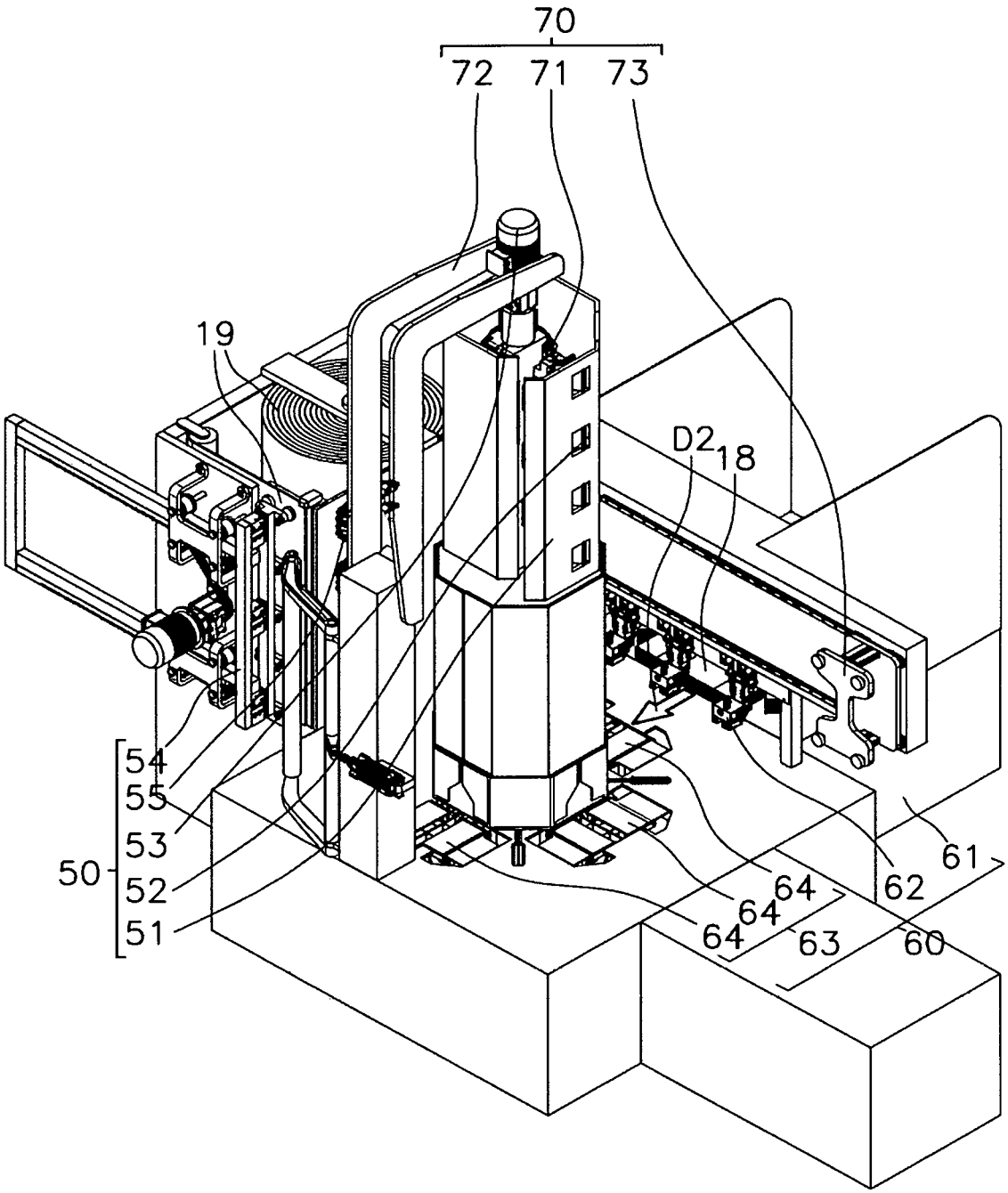
FIG. 15 shows the same view as FIG. 14 but in a subsequent step of the method in which the polygonal rotary drum has been retracted by means of a retraction device by reducing its cross-section, and extracted from the inside of the recently formed tubular polygonal body by means of a vertical movement operated by an extractor device.
Figure 16:
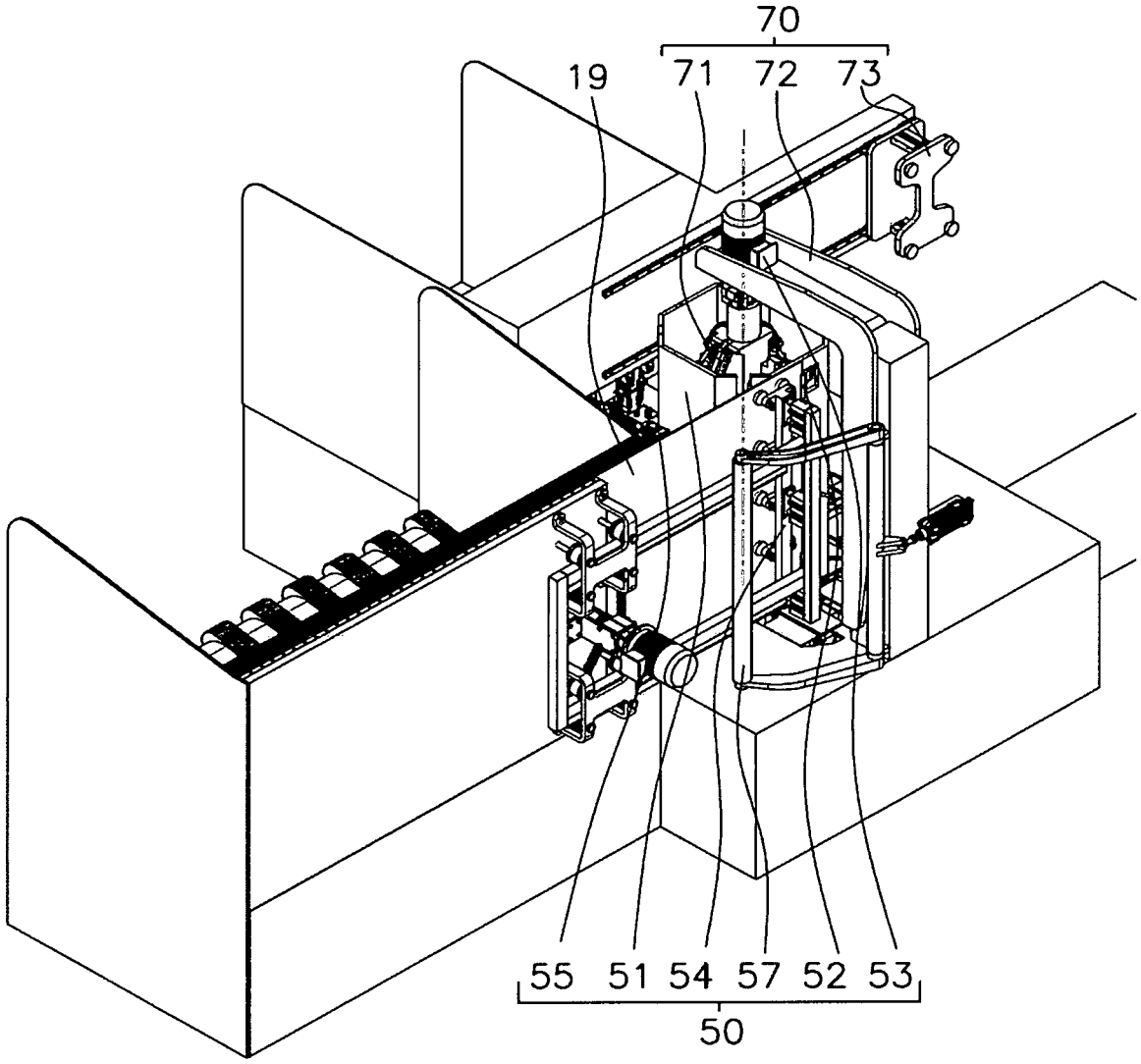
FIG. 16 shows an alternative embodiment of the container forming machine in which the strip of corrugated cardboard is formed by panels of stiff double-faced corrugated cardboard which are stored and fed one by one to the polygonal rotary drum by means of a supplier device for supplying the strip of corrugated cardboard consisting of a carriage linearly guided in the forward movement direction from the storage area for panels of corrugated cardboard to the polygonal rotary drum.
Figure 17:
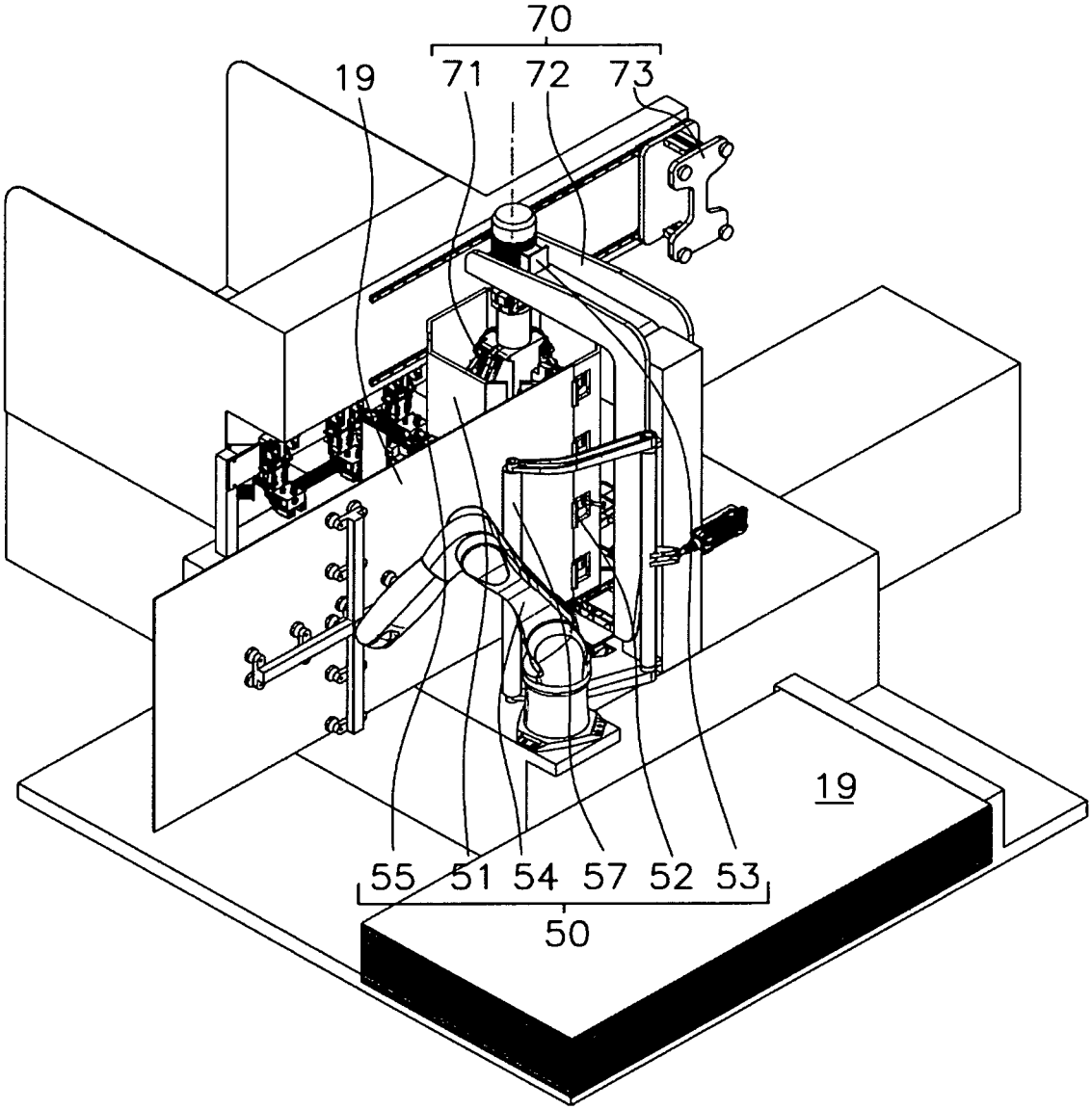
FIG. 17 shows an alternative embodiment of the container forming machine in which the strip of corrugated cardboard is formed by panels of stiff double-faced corrugated cardboard which are stored and fed one by one to the polygonal rotary drum by means of a supplier device for supplying the strip of corrugated cardboard consisting of a robot arm with suction cups.

Furthermore, it has been proposed in FIGS. 8 and 10 for lines of glue to also be applied on the inner surface of the lateral parts 22 of the polygonal base wall before the folding thereof, simultaneously with the application of the lines of glue on the areas corresponding to the flaps 23, thereby allowing the adhesion of the inner surface of the lateral parts 22 to the outer surface of the tubular polygonal body 10 forming the container, either by performing the operation of folding the stiff corrugated cardboard 24 forming the base body 20 directly on a lower end portion of the tubular polygonal body 10, or forming the base body 20 first by means of the folding thereof and then inserting the lower end portion of the tubular polygonal body 10 therein.

Figure 2:
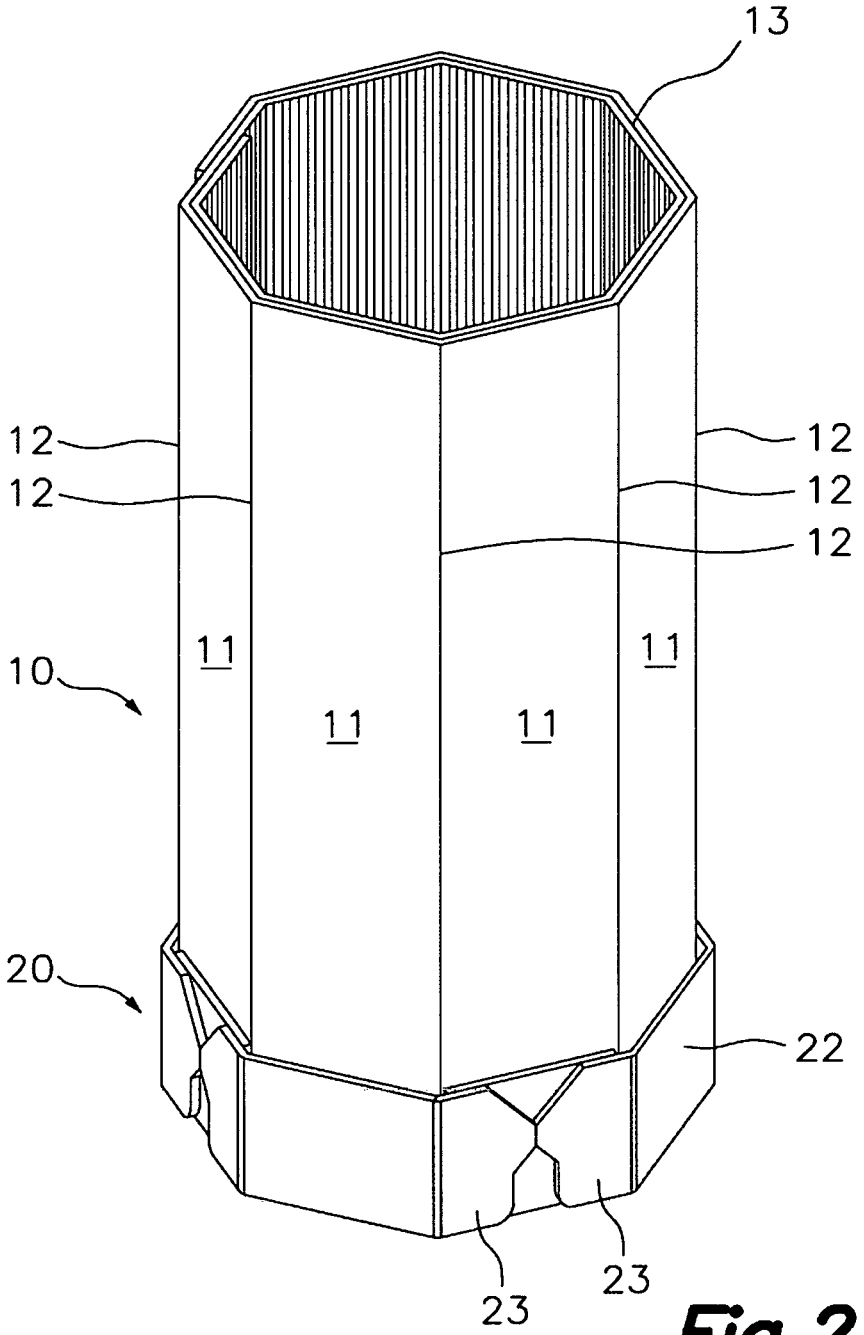
FIG. 2 shows an alternative embodiment of the container in which the corner areas of the tubular polygonal body are edges on the outer surface thereof.
Figure 3:
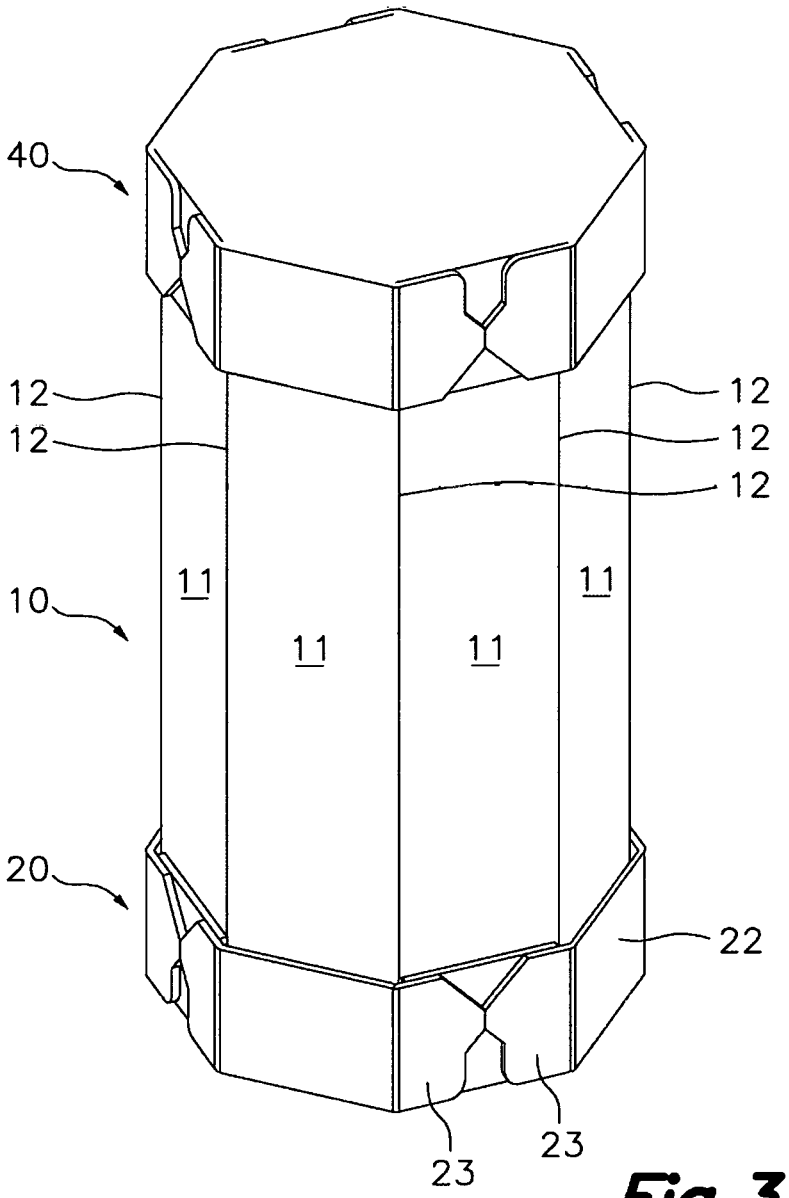
FIG. 3 shows the same container shown in FIG. 2 but attached to a cover body.
Figure 4:
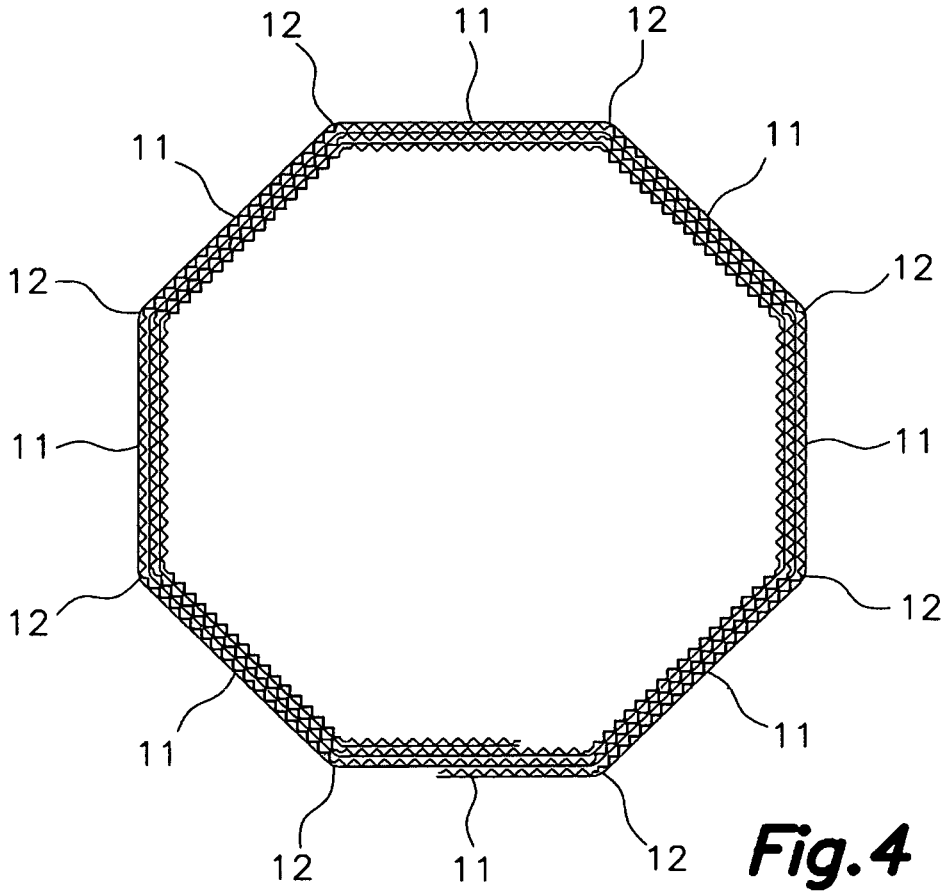
FIG. 4 shows a plan view of an embodiment of the tubular polygonal body, said tubular octagonal polygonal body being formed by three turns of single-faced corrugated cardboard.

The single-faced corrugated cardboard 14 forming the tubular polygonal body 10 will be placed with the corrugation thereof being located in a direction perpendicular to the polygonal bottom 21 of the base body 20, as can be seen FIGS. 1, 2, and 4, i.e., parallel to the folds of the corner areas 12.

Given that the single-faced corrugated cardboard 14 is flexible in one direction, this arrangement of the single-faced corrugated cardboard 14 allows, during the formation of the tubular polygonal body 10, the strip of single-faced corrugated cardboard 14 to adapt to the polygonal shape of the tubular polygonal body 10 without requiring the flattening or cutting of said single-faced corrugated cardboard 14 in the corner areas 12, as it will only be necessary to adapt same to the curvature of the corner area 12.

To adhere the single-faced corrugated cardboard 14 to itself, the arrangement of lines of glue 30 parallel to the polygonal bottom 21 of the base body 20 is proposed, said lines of glue 30 therefore being perpendicular to the corrugation of the single-faced corrugated cardboard 14 forming the tubular polygonal body 10, as shown with discontinuous lines in FIG. 1.

This direction of the lines of glue 30 allows the continuous application thereof on the single-faced corrugated cardboard 14 while it is being rolled up, resulting in a very quick and simple, and therefore low-cost, production process, while at the same time obtaining optimal strength, by assuring that each of the undulations of the corrugated sheet 16 of a layer of the multilayer wall 13 has adhesion points with the smooth sheet 15 on which said corrugated sheet 16 is superimposed, corresponding to another portion of the same single-faced corrugated cardboard 14 forming another layer of the multilayer wall 13 of the tubular polygonal body 10.

In the example shown in FIG. 4, the tubular polygonal body 10 is octagonal, and therefore consists of eight substantially flat faces 11 and eight corner areas 12 located between the faces 11. In this example, all the substantially flat faces 11 are of the same horizontal length, so they form a regular octagon, with the angle existing between two contiguous faces 11 being 135°.

According to another embodiment that is not shown, the number of faces 11 of the tubular polygonal body 10 can be another even number of more than four but other than eight, for example six, forming angles of 120° in the corner areas 12, ten forming angles of 144°, or twelve forming angles of 150°. The angle that the contiguous faces 11 form with respect to one another will preferably be greater than 120°.

In any case, the angle of the corner areas 12 will be an obtuse angle which will require an angle of curvature of the single-faced corrugated cardboard 14 that is rather wide, and therefore readily applicable without damaging the single-faced corrugated cardboard 14.

The accumulation of multiple layers of single-faced corrugated cardboard 14 one on top of another will cause said radius of curvature to become increasingly greater, and therefore it can be assumed even more readily by the single-faced corrugated cardboard 14.

Figure 5:
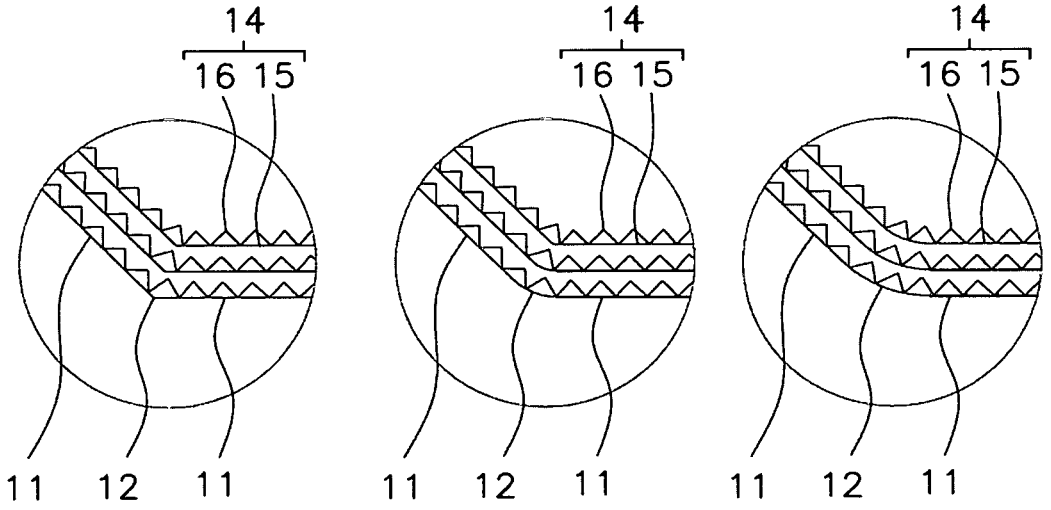
FIG. 5 shows an enlarged corner area of the tubular polygonal body according to three different embodiments, showing a corner area in which all the layers of the single-faced corrugated cardboard have a sharp edge, an embodiment in which only the inner layer, corresponding to the inner surface of the tubular polygonal body has a sharp edge in the corner area with the remaining layers being rounded in said corner area, and a third embodiment in which all the layers of single-faced corrugated cardboard are rounded in the corner area.

This construction allows the thickness of the multilayer wall 13 of the tubular polygonal body 10 to be a constant thickness, both in the substantially flat faces 11 and in the corner areas 12. Furthermore, in the preferred embodiment the outer surface of the corner areas 12 will be rounded, even if the inner surface of the corner area defines an edge, as a result of that increased radius of curvature with each additional layer of the multilayer wall 13, a solution shown in FIGS. 1 and 5.

Optionally, each layer of the multilayer wall 13 can define an edge in the corresponding corner area 12, causing said edge to be visible even on the outer surface of the corner area 12; however, this solution is less favorable as it requires the precise folding of the single-faced corrugated cardboard 14 coinciding with each corner area 12, with the additional problem of the diameter of the multilayer wall 13 varying slightly as layers are added thereto, increasing the length of each face 11, which complicates the production of this embodiment.

In the example shown in FIG. 4, the multilayer wall consists of three layers along its entire perimeter, with only a small overlap of four layers coinciding with the start and end of the strip of single-faced corrugated cardboard 14.

Optionally, it is contemplated that a cover body 40, identical to the base body 20, can be fitted to the end of the tubular polygonal body 10 opposite the end attached to the base body 20.

The inclusion of a plastic bag inside the container, the maximum diameter of which is equal to or greater than the maximum inner cross-section of the tubular polygonal body 10 is also contemplated. This allows storing and preserving a product, even liquid or wet product, in the proposed container, with the hydrostatic pressure produced by the stored material being transmitted to the multilayer wall 13 and not to the plastic bag.

According to another proposed embodiment, the tubular polygonal body 10 is formed by a strip of corrugated cardboard 19 which is a stiff double-faced corrugated cardboard 24. The stiff double-faced corrugated cardboard 24 is in the form of a stiff panel, where the strip of corrugated cardboard can be formed by a single duly folded stiff panel, forming the tubular polygonal body 10, or where the strip of corrugated cardboard can be formed by several stiff panels arranged in succession, one after another, with the respective adjacent ends. When folding the successive panels forming the tubular polygonal body, the joint between successive panels will be integrated in the multilayer wall 13 of the tubular polygonal body 10.

A second aspect of the present invention relates to a method of forming containers. The different steps of the proposed method can be seen in FIGS. 12 to 16.

First, the method consists of forming a tubular polygonal body 10 based on rolling up and adhering a strip of corrugated cardboard 19 to itself by means of a polygonal rotary drum 51 to which an end edge 17 of the strip of corrugated cardboard 19 is fixed, allowing the rotation of the polygonal rotary drum 51 to pull the strip of corrugated cardboard 19 in a forward movement direction D1 while at the same time rolling said strip of corrugated cardboard 19 around same.

The end edge 17 will be parallel to the corrugation of the strip of corrugated cardboard 19, and parallel to the axis of rotation of the polygonal rotary drum 51. The forward movement direction D1 will be transverse to said direction of the corrugation and also transverse to the mentioned axis of rotation.

The strip of corrugated cardboard 19 moved in the forward movement direction D1 passes through an applicator device 55 for lines of glue which deposits multiple parallel lines of glue on one of the faces of the strip of corrugated cardboard 19 before it is rolled around the polygonal rotary drum 51. When the strip of corrugated cardboard 19 is rolled up, it is gradually adhered to itself by means of the mentioned lines of glue which are transverse to the corrugation of the strip of corrugated cardboard 19.

Obviously, the applicator device 55 for lines of glue will be configured to apply lines of glue only on those parts of the strip of corrugated cardboard that will be superimposed on other parts of the strip of corrugated cardboard 19 when being rolled.

Said lines of glue can be applied either on one face or on the other face of the strip of corrugated cardboard 19.

A base panel 18 made of stiff double-faced corrugated cardboard 24 which has been cut is then supplied, defining a polygonal bottom 21 of the same shape and size as the layout of the tubular polygonal body 10, surrounded by lateral parts 22 connected to the edges of the polygonal bottom 21 by means of fold lines. Some of the mentioned lateral parts 22 will have flaps 23 attached by means of fold lines to some of the side edges thereof.

Parallel lines of glue will be arranged on at least some of the lateral parts 22 and/or of the flaps 23 of the base panel 18 and said base panel 18 will then be placed centered with and adjacent to the lower end portion of the tubular polygonal body 10 formed around the polygonal rotary drum 51, closing the opening of the tubular polygonal body 10 with the polygonal bottom 21.

The lateral parts 22 of the base panel 18 are then folded to form a 90° angle with respect to the polygonal bottom 21, said lateral parts 22 being arranged around the lower end portion of the tubular polygonal body 10 surrounding it. The flaps 23 will also be folded in the same operation so that they are superimposed on the lateral parts 22, forming a polygonal base wall with continuous envelopment around the tubular polygonal body 10.

Next, all that is left is to release the end edge 17 from the polygonal rotary drum 51, retract said polygonal rotary drum 51, and extract it vertically from the inside of the formed tubular polygonal body 10. The resulting container can be extracted from the forming machine by means of a delivery device which conveys same to a delivery area of the forming machine.

The last aspect of the proposed invention is the container forming machine.

The proposed machine has a tubular polygonal body forming station 50, in charge of forming a tubular polygonal body 10 from a strip of corrugated cardboard 19, a base body forming station 60 in charge of forming a base body 60 and connecting it to the lower end portion of the formed tubular polygonal body 10, and finally an extraction station 70 intended for extracting the formed polygonal containers from the inside of the forming machine, allowing the formation of a new container.

According to a preferred embodiment, the tubular polygonal body forming station 50 comprises a storage area for the strip of corrugated cardboard, a polygonal rotary drum 51, and a supplier device 54 for the strip of corrugated cardboard 19 conveying the strip of corrugated cardboard 19 from the storage area to the polygonal rotary drum 51 by means of the movement thereof in the forward movement direction D1.

According to the embodiment shown in the drawings, the supplier device 54 for the strip of corrugated cardboard 19 consists of a carriage horizontally movable along a horizontal guide parallel to the forward movement direction D1 and driven by an actuator which is proposed to be a motor in this case.

Said carriage is provided with vacuum suction cups connected to a vacuum generator and oriented to be superimposed on a face of the strip of corrugated cardboard 19, securing it by suction and allowing it to be pulled when the carriage moves in the forward movement direction D1.

The tubular polygonal body forming station 50 is completed with an applicator device 55 for lines of glue and a releasable fixing device 52 integrated in the polygonal rotary drum 51 intended for retaining an end edge 17 of the strip of corrugated cardboard 19 while the polygonal rotary drum 51 rotates on its axis of rotation, rolling the strip of corrugated cardboard 19 around same.

According to the embodiment shown FIGS. 12 to 16, the strip of corrugated cardboard 19 is single-faced corrugated cardboard 14 rolled on a drum, the supplier device is a carriage provided with suction cups linearly movable in the forward movement direction D1 to grip a portion of the strip of corrugated cardboard adjacent to the end edge 17 thereof and convey same in the forward movement direction D1 until locating said end edge 17 on the polygonal rotary drum 51 where the releasable fixing device 52 fixes said end edge 17 on the polygonal rotary drum 51, said end edge 17 being parallel to the axis of rotation of the polygonal rotary drum 51.

In this embodiment, the releasable fixing device 52 consists of retractable fingers 80 which are superimposed on the outer face of a vertical panel 74 forming the polygonal rotary drum 51, retaining the end edge 17. To release said end edge 17, the mentioned fingers are concealed inside the polygonal rotary drum 51.

Therefore, said releasable fixing device 52 comprises a retractable finger 80 and a finger actuator 81, for example, a piston or a motor, actuating the pivoting movement of said retractable finger 80. According to a preferred embodiment, the finger actuator 81 is a pneumatic cylinder supported in an articulated manner by means of a vertical shaft in an inner structure of the polygonal rotary drum 51. The finger actuator 81 drives a part, also articulated with respect to the inner structure of the polygonal rotary drum 51, at the end of which there is located the retractable finger 80, causing the rotation thereof and the movement of the retractable finger 80 between an initial standby position, in which the retractable finger 80 is housed inside the polygonal rotary drum 51, and an active position in which the retractable finger 80 projects from the polygonal rotary drum 51, for example through a window made in said vertical panel 74, being partially superimposed on an outer face of one of the vertical panels 74 of said polygonal rotary drum 51, retaining an end edge 17 of a strip of corrugated cardboard 19.

Figure 19:
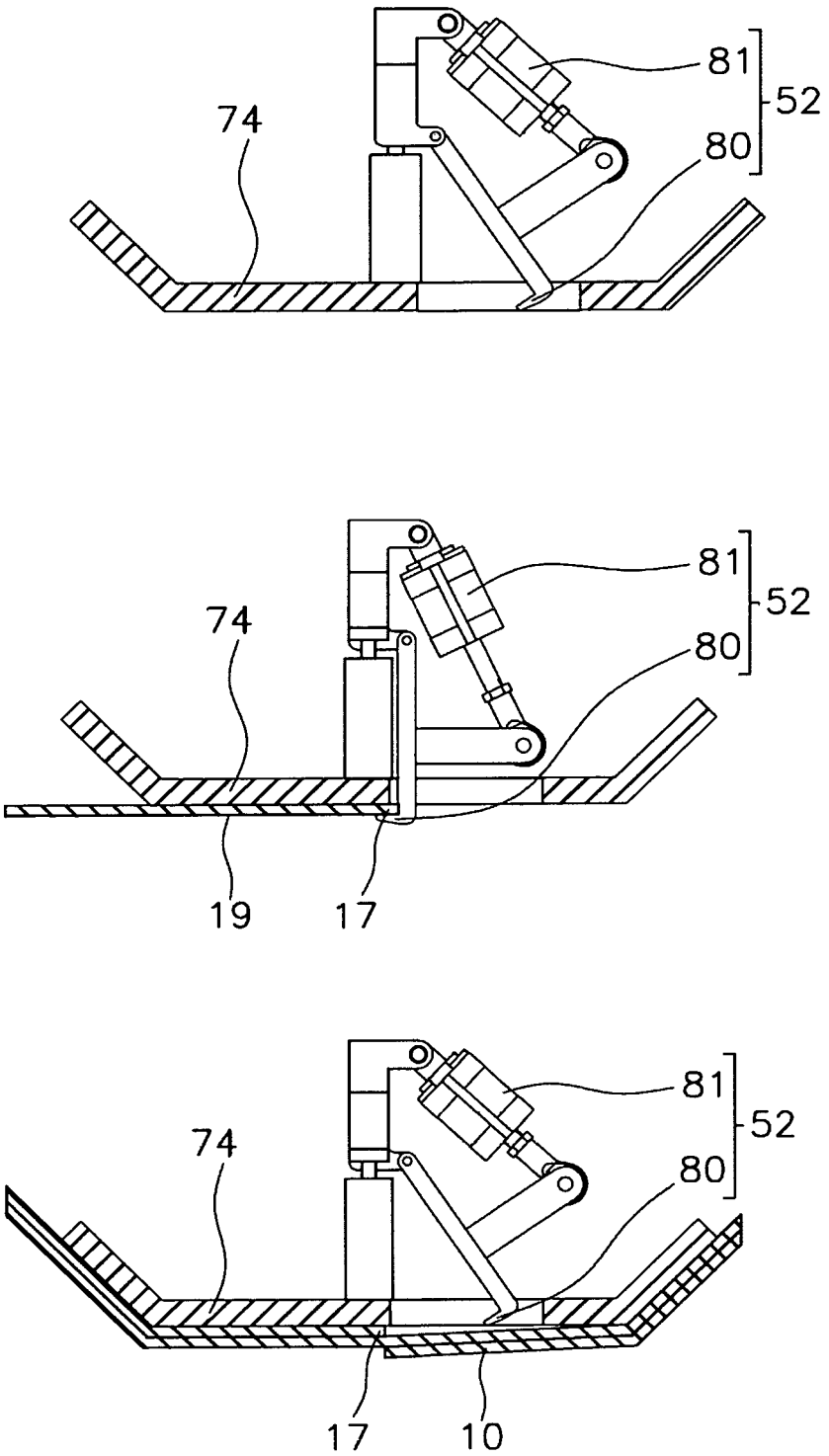
FIG. 19 shows three detailed plan views of a portion of the polygonal rotary drum including a releasable fixing device for fixing an end edge of the strip of corrugated cardboard to the polygonal rotary drum according to a first embodiment of said device, with three different positions of the device being shown.

FIG. 19 shows this embodiment in three different positions, a first standby position, a second active position, and a third standby position after the formation of a tubular polygonal body 10.

Figure 20:
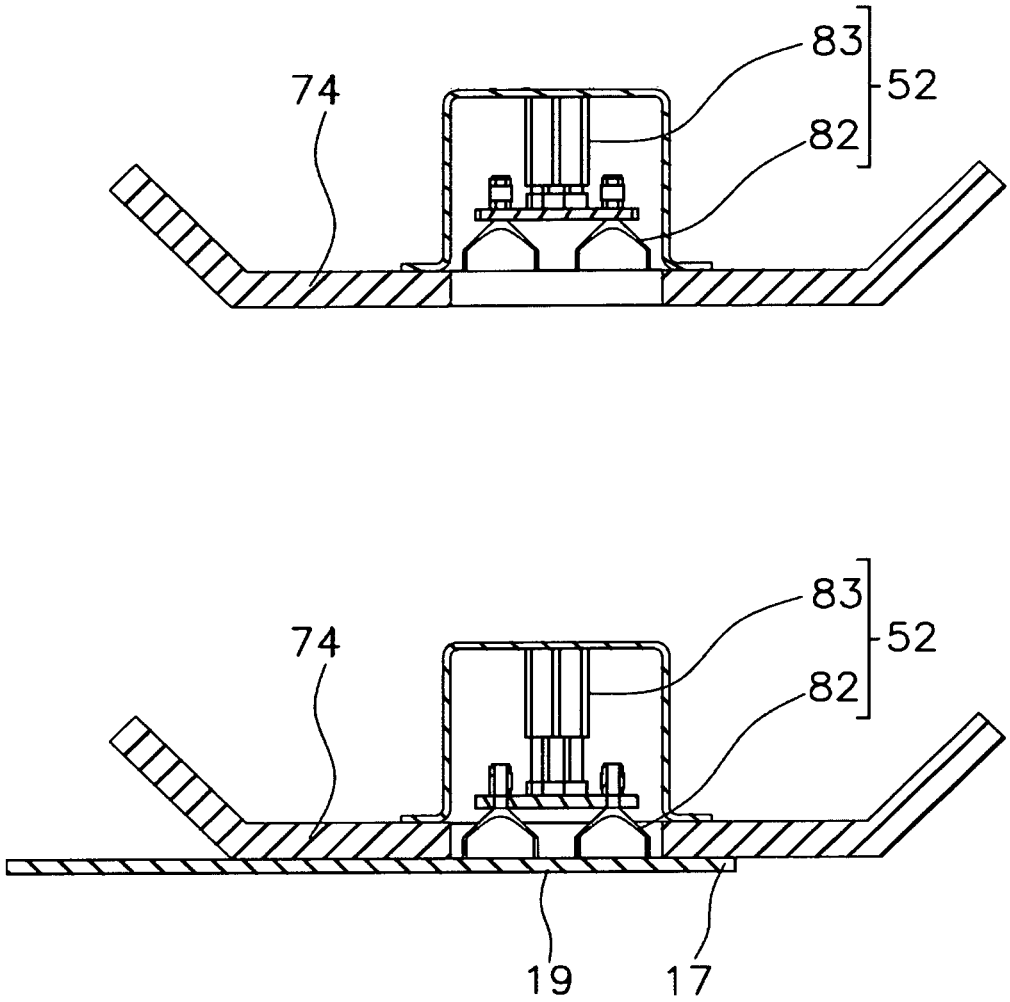
FIG. 20 shows the same view as FIG. 19 but according to another different embodiment of the releasable fixing device.

FIG. 20 shows an alternative embodiment of the releasable fixing device 52 which, in this example, comprises vacuum suction cups 82 connected to a vacuum generator and supported in the inner structure of the polygonal rotary drum 51. The suction cups 82 are housed inside the polygonal rotary drum 51, but their active part in which suction occurs is oriented towards and accessible from the outside of the polygonal rotary drum 51 through windows provided in at least one of the vertical panels 74 of the polygonal rotary drum 51.

In the active position, the suction cups 82 will be coplanar or project partially from the outer face of the polygonal rotary drum 51 on which the tubular polygonal body 10 is formed. By supporting a portion of the strip of corrugated cardboard 19 adjacent to the end edge 17 on the suction cups, it will be fixed by the action of the vacuum suction cups 82.

Optionally, it is contemplated that the releasable fixing device 52 further comprises a suction cup actuator 83 in the shape of an extendable rod on which the suction cups 82 are fixed, allowing the movement of the suction cups 82 in a radial direction with respect to the polygonal rotary drum 51 so that they project partially from the polygonal rotary drum 51 or so that they are completely retracted into the drum.

The polygonal rotary drum 51 of the polygonal tubular body forming station 50 is arranged with its axis of rotation being vertical, supported at its upper end by means of an arm 72, the polygonal rotary drum 51 being vertically suspended above the folder device 63 and the assembly position but separated from same by a supply passage in the form of a gap between the lower end of the polygonal rotary drum 51 and the folder device 63 through which a base panel 18 can be introduced in a supply direction D2 for supplying base panels from a storage area to the assembly position by means of the supplier device 61 for base panels.

A driving member 53 will actuate the polygonal rotary drum 51 to cause the rotation thereof around the mentioned vertical axis, rolling the strip of corrugated cardboard 19 around same.

A hold-down member 57 may collaborate with the polygonal rotary drum 51 to press the strip of corrugated cardboard 19 against the mentioned polygonal rotary drum 51, achieving better adhesion of the layers forming the tubular polygonal body 10, for example in the shown embodiments the hold-down member 57 consists of a roller parallel to the axis of rotation of the polygonal rotary drum 51 located at the end of a pivoting arm. Said hold-down member 57 can swing, modifying its distance with respect to the center of the polygonal rotary drum 51, and it can therefore be adapted to the polygonal contour thereof, to the increasing thickness of the tubular polygonal body 10 as it is formed, or separated from the same to allow coupling the end edge 17 of a new strip of corrugated cardboard 19 to the polygonal rotary drum 51 or to release a recently formed tubular polygonal body 10 from the polygonal rotary drum 51.

Figure 18:
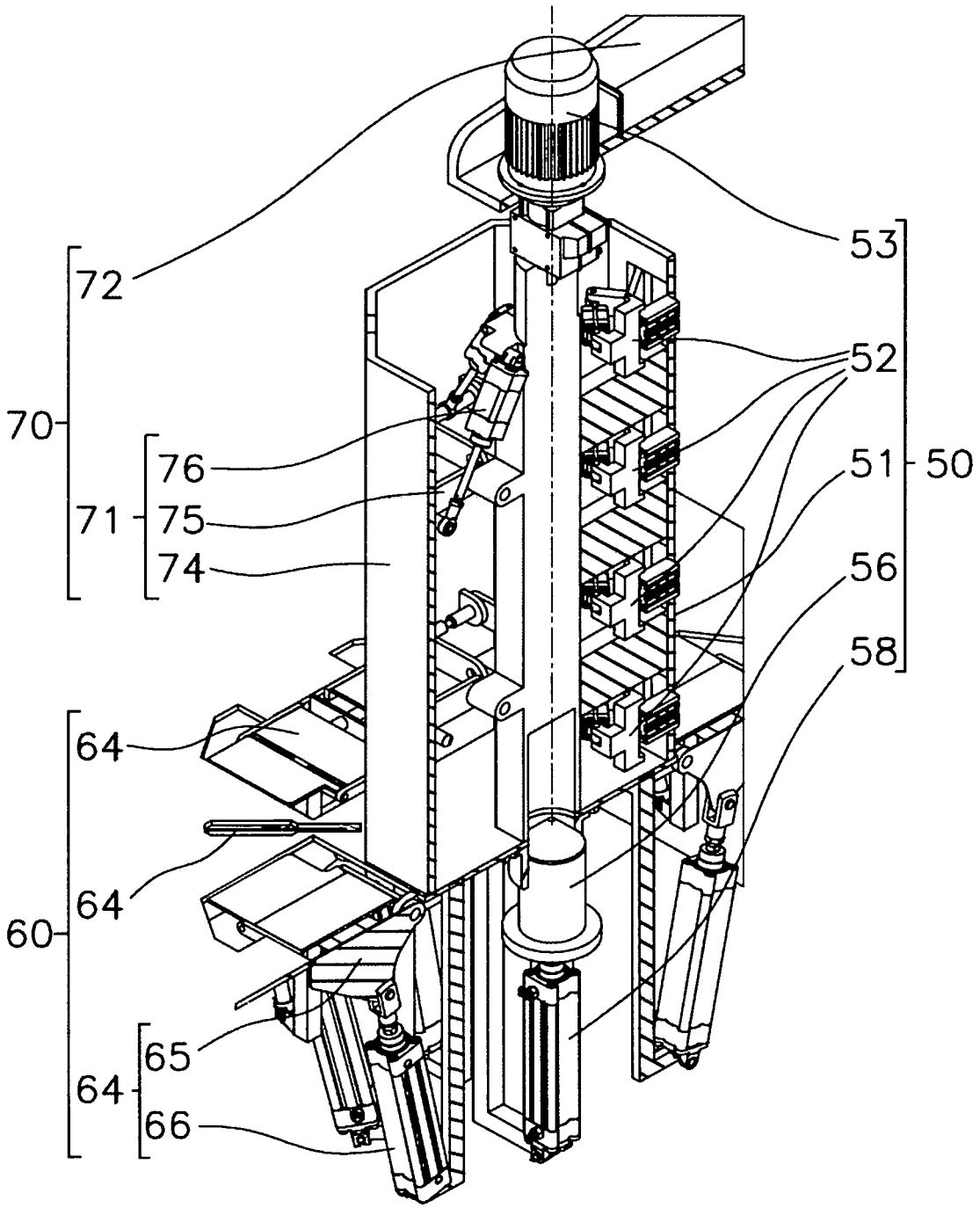
FIG. 18 shows a sectioned perspective view of the polygonal rotary drum and the folder device.

Optionally it is contemplated that a retractable shaft 56 can traverse the supply passage, temporarily interrupting same for fixing the center of the lower end of the polygonal rotary drum 51 to a lower chassis, allowing the rotation thereof, as can be seen FIG. 18.

This allows the polygonal rotary drum 51 to rotate in a centered manner, applying tension on the strip of corrugated cardboard 19 as it is being rolled up.

FIG. 18 shows said retractable shaft 56 according to an envisaged embodiment, whereby the retractable shaft 56 is connected to a retractable shaft actuator 58 in the form of a piston which allows moving said retractable shaft 56 vertically between a standby position, in which is it completely located below the mentioned supply passage and decoupled from the polygonal rotary drum 51, and an active position in which the retractable shaft 56 traverses the mentioned supply passage and is tightly inserted in a complementary housing envisaged in the center of the lower end portion of the polygonal rotary drum 51, aligned with the axis of rotation thereof.

Obviously, the coupling between the retractable shaft 56 and the polygonal rotary drum 51 will allow rotation of the polygonal rotary drum 51, so it is proposed to include, for example, bearings between the retractable shaft 56 and the retractable shaft actuator or between the retractable shaft 56 and the housing of the polygonal rotary drum 51. It is even contemplated that the housing is supported with the rest of the polygonal rotary drum through bearings to allow the rotation thereof.

According to an alternative embodiment that is not shown, the retractable shaft 56 and its retractable shaft actuator can be housed inside the polygonal rotary drum 51, with the retractable shaft 56 being moved upwards to be housed in a housing envisaged in the lower chassis located below the base panel supply passage.

The polygonal rotary drum 51 is formed by an inner structure attached to the vertical rotating shaft, on which multiple vertical panels 74 defining the polygonal envelopment of the polygonal rotary drum 51 are fixed.

In the examples shown in the drawings, the machine is envisaged for the formation of octagonal containers, so the polygonal rotary drum 51 defines eight vertical faces in its envelopment. In this embodiment, the polygonal rotary drum 51 consists of four panels located in four quadrants of the polygonal rotary drum 51, each panel including two inclined or beveled ends, each panel therefore defining an outer face of the envelopment of the polygonal rotary drum 51 and also two other adjacent faces in a partial manner.

The polygonal tubular body forming station 50 is completed with the applicator device 55 for lines of glue consisting of a bridge supporting multiple applicators of lines of glue.

The supplier device 54 for the strip of corrugated cardboard 19 conveys said strip of corrugated cardboard 19 in a vertical position in the forward movement direction D1, the strip of corrugated cardboard 19 passing in front of the bridge forming the applicator device 55 for lines of glue, said bridge therefore being in a vertical position. As the strip of corrugated cardboard 19 moves in front of the applicators of lines of glue in the forward movement direction D1, said applicators deposit lines of glue parallel to the forward movement direction D1 on a face of the strip of corrugated cardboard 19.

Obviously, the applicator device 55 of lines of glue will be coordinated with the supplier device 54 for depositing lines of glue only in those areas of the strip of corrugated cardboard 19 intended for being superimposed with other areas of the strip of corrugated cardboard 19 after being rolled around the polygonal rotary drum 51.

According to a preferred embodiment, the base body forming station 60 comprises a folder device 63, a storage area for base panels 18, a supplier device 61 for base panels 18 conveying the base panels 18 from the storage area to the folder device 63 by moving them in a supply direction D2 through a supply passage defined between the lower end portion of the polygonal rotary drum 51 and the folder device 63 located below same. The base body forming station 60 further comprises an applicator device 62 for lines of glue located above the supply passage and configured for applying lines of glue on discrete areas of the base panels 18 conveyed through the supply passage, said lines of glue being parallel to the supply direction D2.

In this case, the base panels 18 are conveyed in a horizontal position, the supply direction D2 also being horizontal. The applicator device 62 for lines of glue consists of a bridge located above the supply passage, on which multiple applicators of lines of glue are supported superimposed on the supply passage. When a base panel 18 is conveyed in the supply direction D2, the applicators of lines of glue supply glue in coordination with the supplier device 61 for depositing said lines of glue only in predetermined areas of said base panels 18, the base panels 18 therefore reaching the assembly position with the lines of glue already deposited thereon.

The folder device 63 is located right below the polygonal rotary drum 51 and consists of a plurality of folder units 64 arranged like petals surrounding the base of the polygonal rotary drum 51 below the base panel supply passage.

It is observed in FIGS. 12 to 18 that there is located below the polygonal rotary drum 51 a folder device 63 which, in the shown embodiment relating to an octagonal container forming machine, consists of eight folder units 64 supported in the lower chassis of the machine and radially arranged below and around the lower end portion of the polygonal rotary drum 51, below the assembly position where the base panels 18 are placed before folding.

Each folder unit 64 comprises a pivoting arm 65 articulated with respect to the lower chassis around a horizontal axis parallel to and vertically aligned with one of the faces of the polygonal rotary drum 51 positioned in the holding position, such that the rotation of the pivoting arm 65 allows said pivoting arm 65 to be arranged parallel to and facing a lower end portion of a face of the polygonal rotary drum 51 located in the holding position.

A folder unit actuator 66, which is a piston in this embodiment, actuates each pivoting arm 65 to move it from a standby position, in which it is located below the supply passage for base panels 18 and below the assembly position, therefore allowing the supplier device 61 for base panels 18 to supply a base panel 18 through said supply passage until placing it in the assembly position, to a folding position in which each pivoting arm 65 is upright and facing a lower end portion of one of the outer faces of the polygonal rotary drum 51 in the holding position, causing parts of the base panel 18 located in the assembly position to be folded and pressed against the outer surface of the lower end portion of a tubular polygonal body 10 formed around the polygonal rotary drum 51, adhering them.

The machine is completed with an extraction station 70 intended for extracting the formed containers from inside the machine, therefore allowing the formation of a new container.

For the extraction of a recently formed container, the polygonal rotary drum 51 must be extracted from the inside of the tubular polygonal body 10 formed around same. To that end, it is proposed to provide the polygonal rotary drum 51 with a retraction device 71 envisaged for reducing the cross-section of the polygonal rotary drum 51, thereby having clearance inside the tubular polygonal body 10, facilitating the extraction thereof.

FIG. 18 shows an embodiment of the retraction device 71 whereby one or more of the vertical panels 74 defining the envelopment of the polygonal rotary drum 51 described above are attached to the central structure through multiple pivoting arms 75, with each pivoting arm 75 being articulated around horizontal shafts.

This construction allows each panel of the polygonal rotary drum 41 to move vertically, modifying its distance with respect to the central structure of the polygonal rotary drum 51 and therefore modifying the cross-section of the polygonal rotary drum 51.

A retraction actuator 76 which consists of a piston in this case controls the movement of each vertical panel 74 determining its position at all times.

This allows not only extracting the formed container, but also modifying the size of the tubular polygonal body 10 to be formed at all times.

The extraction station 70 further comprises an extractor device 72 moving the polygonal rotary drum 51 in a vertical direction parallel to its axis of rotation, allowing the extraction thereof from the inside of the formed container.

In this case, the polygonal rotary drum 51 is suspended from an arm at its lower end. Said arm is connected in a sliding manner to a vertical guide and an arm actuator which causes the movement of said arm along the vertical guide, lifting the polygonal rotary drum 51.

Optionally, it is contemplated that the extraction station 70 additionally comprises a container conveyor 73 envisaged for moving the formed containers after the extraction of the polygonal rotary drum 51 from the inside thereof to an extraction area of the machine, preferably in a horizontal direction.

In the example shown in the drawings, the container conveyor consists of a carriage horizontally movable along a horizontal guide. The carriage includes vacuum suction cups connected to a vacuum generator, the carriage being located such that, at one end of its path, the suction cups are in contact with the outer face of the formed container, and at the other end of its path, it is adjacent to the extraction area.

Optionally, the suction cups or the carriage can be connected to an actuator which causes the movement thereof in a horizontal direction transverse to the horizontal carriage guide, allowing the suction cups to be moved closer to or away from the formed container.

It will be understood that the different parts making up the invention described in one embodiment can be freely combined with parts described in other different embodiments even though said combination has not been explicitly described, provided that the combination does not entail any drawbacks.

What is claimed is:

1. A reinforced polygonal container made of glued corrugated laminar material comprising:

a tubular polygonal body with an even number of flat faces numbering more than four defined between corner areas, the tubular polygonal body being formed by a strip of glued corrugated laminar material rolled up at least two full turns and adhered to itself by lines of glue forming a multilayer wall, wherein said glued corrugated laminar material is a cardboard;

a base body defined by a base panel formed by cut and folded stiff double-faced glued corrugated laminar material defining a polygonal bottom and a polygonal base wall surrounding the polygonal bottom and perpendicular thereto, the polygonal base wall having the same number of sides as the tubular polygonal body and an inner surface of each side of the polygonal base wall being superimposed on and adhered to a lower end portion of an outer surface of the faces of the tubular polygonal body, attaching the base body around said lower end portion of the tubular polygonal body, wherein said glued corrugated laminar material is a cardboard, wherein the cardboard of the tubular polygonal body includes a corrugated sheet forming channels perpendicular to the polygonal bottom of the base body; and wherein the lines of glue are several lines of glue transverse to the channels of the corrugated sheet, the lines of glue extending around the container offering structural reinforcement with respect to radial expansion stresses of the container.

2. The reinforced polygonal container according to claim 1, wherein the end portion of the tubular polygonal body, around which the polygonal base wall is adhered and superimposed, includes at least part of the mentioned lines of glue which attach the strip of corrugated cardboard to itself.

3. The reinforced polygonal container according to claim 2, wherein the length of the strip of corrugated cardboard is equal to several times the perimeter of the tubular polygonal body plus an overlapping area equal to or less than the length of a face of the tubular polygonal body or comprised between 5 cm and 15 cm.

4. The reinforced polygonal container according to claim 1, wherein the cardboard forming the tubular polygonal body is a single-faced corrugated cardboard made of one smooth sheet and one corrugated sheet bonded together.

5. The reinforced polygonal container according to claim 4, wherein the multilayer wall of the tubular polygonal body consists of between 3 and 7 layers of single-faced corrugated cardboard, and wherein said cardboard of the base body has at least a further adhered corrugated sheet and a further adhered smooth sheet providing a triple-faced corrugated cardboard.

6. The reinforced polygonal container according to claim 4, where in the multilayer wall of the tubular polygonal body consists of between 3 and 7 layers of single-faced corrugated cardboard, and wherein the thickness of the multilayer wall on said flat faces is equal to the thickness in the corner areas.

7. The reinforced polygonal container according to claim 1, wherein the strip of cardboard forming the tubular polygonal body is a panel or several successive panels with adjacent ends, of stiff double-faced corrugated cardboard, with the corner areas being formed by folds of the strip of corrugated cardboard.

8. The reinforced polygonal container according to claim 1, wherein said cardboard of the base body has at least a further adhered corrugated sheet and a further adhered smooth sheet providing a triple-faced corrugated cardboard.

9. The reinforced polygonal container according to claim 1, wherein the length of the strip of corrugated cardboard is equal to several times the perimeter of the tubular polygonal body plus an overlapping area equal to or less than the length of a face of the tubular polygonal body or comprised between 5 cm and 15 cm.

10. The reinforced polygonal container according to claim 1, wherein the thickness of the multilayer wall on said flat faces is equal to the thickness in the corner areas.

11. The reinforced polygonal container according to claim 1, wherein the sides of the polygonal base wall are formed by lateral parts connected to the polygonal bottom by fold lines and attached together by flaps connected to at least some of said lateral parts by fold lines and adhered to adjacent lateral parts of the polygonal base wall by lines of glue parallel to one another in the flat layout of the base body, forming a closed envelopment that completely surrounds the lower end portion of the tubular polygonal body.

12. The reinforced polygonal container according to claim 11, wherein the inner surface of the polygonal base wall is attached to the outer surface of the lower end portion of the tubular body by lines of glue parallel to one another in a flat layout of the base body and parallel to the lines of glue attaching the flaps to the lateral parts.

13. A method of forming reinforced polygonal containers, which comprises:

forming a tubular polygonal body made of corrugated cardboard;

feeding a stiff double-faced corrugated cardboard defined by a base panel formed by a polygonal bottom surrounded by lateral parts and flaps forming a polygonal base wall with same number of sides as the tubular polygonal body, the lateral parts being connected to the polygonal bottom by fold lines and the flaps being connected to the lateral parts by fold lines;

applying lines of glue parallel to one another on areas of the base panel;

positioning the base panel adjacent to and centered with a lower end portion of the tubular polygonal body, closing said lower end portion with the polygonal bottom;

folding the lateral parts and flaps of the base panel along the fold lines by pressing them against an outer surface of said lower end portion of the tubular polygonal body forming and adhering the polygonal base wall around the lower end portion of the tubular polygonal body;

wherein the step of forming the tubular polygonal body comprises:

retaining an end edge of a strip of corrugated cardboard on a polygonal rotary drum with an even number of flat facets numbering more than four, wherein channels of a corrugated sheet included in the strip of corrugated cardboard are parallel to an axis of rotation of the polygonal rotary drum;

applying lines of glue parallel to one another and transverse to the channels of corrugated sheet on a face of the strip of corrugated cardboard;

supplying the strip of corrugated cardboard in a forward movement direction transverse to the channels while at the same time rotating the polygonal rotary drum around the axis of rotation at least two full turns, causing the rolling of the strip of corrugated cardboard around itself, forming a tubular polygonal body with a multilayer wall; and releasing the end edge and extracting the tubular polygonal body from the polygonal rotary drum.

14. The method according to claim 13, wherein formation and adhesion of the polygonal base wall around the lower end portion of the tubular polygonal body are performed before extracting the tubular polygonal body from the polygonal rotary drum.

15. The method according to claim 14, wherein the base panel is positioned with respect to the tubular polygonal body by movement in a direction perpendicular to the axis of rotation of the polygonal rotary drum and parallel to the direction of the lines of glue which are applied on said base panel during said movement.

16. The method according to claim 14, wherein the lines of glue applied on the strip of corrugated cardboard are applied at the same time as the rolling of said strip of corrugated cardboard, said lines of glue being parallel to the forward movement direction.

17. The method according to claim 13, wherein the lines of glue applied on the strip of corrugated cardboard are applied at the same time as the rolling of said strip of corrugated cardboard, said lines of glue being parallel to the forward movement direction.

18. The method according to claim 13, wherein the lines of glue combine lines of cold glue and lines of hot glue.

19. A reinforced polygonal container forming machine, including:

a tubular polygonal body forming station configured for holding a tubular polygonal body in a holding position;

a base body forming station comprising:

a supplier device for base panels configured for supplying base panels in a supply direction through a supply passage to an assembly position adjacent to a lower end portion of a tubular polygonal body located in the holding position;

an applicator device for lines of glue configured for applying lines of glue on each of said base panels as they move in the supply direction;

a folder device consisting of multiple folder units arranged facing the assembly position, each being movable between a standby position in which they interfere with neither the supply passage nor the assembly position, and a folding position in which the folder units interfere with the assembly position and are arranged around the holding position, causing the folding of parts of a base panel located in the assembly position by pressing them against a lower end portion of a tubular polygonal body located in the holding position;

wherein the tubular polygonal body forming station comprises:

a polygonal rotary drum defining an even number of flat facets numbering more than four which determine a holding position around the polygonal rotary drum and including a releasable fixing device for fixing an end edge of a strip of corrugated cardboard, said polygonal rotary drum being connected to a cantilevered rotating shaft operated by a driving member;

a supplier device for the strip of corrugated cardboard configured for moving the strip of corrugated cardboard in a forward movement direction transverse to the axis of rotation of the polygonal rotary drum;

an applicator device for lines of glue consisting of a bridge of applicators of lines of glue configured for depositing lines of glue on a face of the strip of corrugated cardboard as it moves in the forward movement direction; and wherein the machine furthermore includes a formed polygonal container extraction station comprising:

a retraction device of the polygonal rotary drum configured for reducing the cross-section thereof;

an extractor device configured for moving the polygonal rotary drum in a direction parallel to its axis of rotation for the extraction thereof from the inside of the formed container.

20. The machine according to claim 19, wherein each applicator device for lines of glue of the polygonal tubular body forming station and/or of the base body forming station includes a combination of cold glue and hot glue applicators.

21. The machine according to claim 20, further comprising a hold-down member located at an end of a pivoting arm modifying the distance between the hold-down member and the center of the polygonal rotary drum, between a pressure position in which the hold-down member presses the strip of corrugated cardboard against the polygonal rotary drum, adapting the position of the hold-down member to the polygonal contour of the polygonal rotary drum as it rotates, and a standby position separated from the strip of corrugated cardboard and from the polygonal rotary drum.

22. The machine according to claim 19, further comprising a hold-down member located at the end of a pivoting arm modifying the distance between the hold-down member and the center of the polygonal rotary drum, between a pressure position in which the hold-down member presses the strip of corrugated cardboard against the polygonal rotary drum, adapting the position of the hold-down member to the polygonal contour of the polygonal rotary drum as it rotates, and a standby position separated from the strip of corrugated cardboard and from the polygonal rotary drum.

23. The machine according to claim 22, further comprising a retractable shaft coaxial to the center of the polygonal rotary drum movable by a retractable shaft actuator between a coupled position in which the retractable shaft rotatably connects the cantilevered end of the polygonal rotary drum to a support chassis, and a decoupled position in which the retractable shaft disconnects said cantilevered end of the polygonal rotary drum from the mentioned chassis.

24. The machine according to claim 19, further comprising a retractable shaft coaxial to the center of the polygonal rotary drum movable by a retractable shaft actuator between a coupled position in which it rotatably connects the cantilevered end of the polygonal rotary drum to a support chassis, and a decoupled position in which it disconnects said cantilevered end of the polygonal rotary drum from the mentioned chassis.

* * * * *